US010208553B2

(12) United States Patent
Sullivan et al.

(10) Patent No.: US 10,208,553 B2
(45) Date of Patent: Feb. 19, 2019

(54) MAGNETIC RETRIEVAL APPARATUS

(71) Applicant: Weatherford Technology Holdings, LLC, Houston, TX (US)

(72) Inventors: Michael K. Sullivan, Katy, TX (US); Arthur Warren Meeks, Porter, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 936 days.

(21) Appl. No.: 14/532,594

(22) Filed: Nov. 4, 2014

(65) Prior Publication Data

US 2015/0122480 A1 May 7, 2015

Related U.S. Application Data

(60) Provisional application No. 61/900,206, filed on Nov. 5, 2013.

(51) Int. Cl.

| | |
|---|---|
| ***E21B 31/06*** | (2006.01) |
| *E21B 17/10* | (2006.01) |
| *E21B 37/00* | (2006.01) |

(52) U.S. Cl.

CPC ..... *E21B 31/06* (2013.01); *E21B 17/1078* (2013.01); *E21B 37/00* (2013.01); *Y10T 29/49895* (2015.01); *Y10T 29/53657* (2015.01)

(58) Field of Classification Search

CPC ..... E21B 31/06; E21B 17/1078; E21B 37/00; Y10T 29/49895; Y10T 29/53657

See application file for complete search history.

(56) References Cited

U.S. PATENT DOCUMENTS

| | | | |
|---|---|---|---|
| 2,417,762 | A | 3/1947 | Koller |
| 2,729,494 | A | 1/1956 | Trowbridge |
| 2,918,323 | A | 12/1959 | Coffee |
| 2,965,406 | A | 12/1960 | Le Bos, Sr. |
| 3,020,079 | A | 2/1962 | Samol |
| 3,067,821 | A | 12/1962 | Crooks |
| 3,089,724 | A | 5/1963 | Crooks |

(Continued)

FOREIGN PATENT DOCUMENTS

| | | |
|---|---|---|
| CN | 102118084 | 7/2011 |
| CN | 202047773 U | 11/2011 |

(Continued)

OTHER PUBLICATIONS

Canadian Office Action dated Jun. 28, 2017, for Canadian Patent Application No. 2,869,299.

(Continued)

*Primary Examiner* — Robert E Fuller
*Assistant Examiner* — Christopher J Sebesta
(74) *Attorney, Agent, or Firm* — Patterson + Sheridan LLP

(57) ABSTRACT

A downhole retrieval tool includes a mandrel; an inner sleeve disposed around the mandrel; a plurality of magnets coupled to the inner sleeve; and an outer sleeve disposed around the plurality of magnets, wherein the inner sleeve and the plurality of magnets are rotatable relative to the mandrel. In another aspect, an assembly tool for handling a magnet includes an anchor; a conveyance movable relative to the anchor; and a magnet holder coupled to the conveyance, wherein the magnet holder includes an arm for retaining the magnet.

23 Claims, 37 Drawing Sheets

(56) References Cited

U.S. PATENT DOCUMENTS

| | | | | |
|---|---|---|---|---|
| 3,520,359 | A | 7/1970 | Ehrlich | |
| 3,637,033 | A | 1/1972 | Mayall | |
| 3,905,631 | A | 9/1975 | Ricks et al. | |
| 4,084,636 | A * | 4/1978 | Burge | E21B 4/02 166/66.5 |
| 4,113,611 | A | 9/1978 | Gohm | |
| 4,345,350 | A | 8/1982 | Burd | |
| 5,224,548 | A | 7/1993 | Dankovich, II | |
| 5,682,950 | A | 11/1997 | Bjornstad | |
| 5,819,353 | A * | 10/1998 | Armell | E21B 37/02 15/104.05 |
| 5,944,100 | A | 8/1999 | Hipp | |
| 6,216,787 | B1 | 4/2001 | Ruttley | |
| 6,308,781 | B2 | 10/2001 | Ruttley | |
| 6,354,386 | B1 | 3/2002 | Ruttley | |
| 6,357,539 | B1 | 3/2002 | Ruttley | |
| 6,439,303 | B1 * | 8/2002 | Sorhus | E21B 31/06 166/311 |
| 6,491,117 | B2 | 12/2002 | Ruttley | |
| 6,629,562 | B1 | 10/2003 | Fidan | |
| 6,655,462 | B1 | 12/2003 | Carmichael et al. | |
| 7,137,449 | B2 | 11/2006 | Silguero | |
| 7,174,957 | B1 | 2/2007 | Jokhio | |
| 7,219,724 | B2 | 5/2007 | Theriot, Sr. | |
| 7,255,164 | B2 | 8/2007 | Tulloch et al. | |
| 7,357,183 | B2 | 4/2008 | Gazewood | |
| 7,410,014 | B2 | 8/2008 | Ruttley | |
| 7,513,299 | B2 | 4/2009 | Ruttley | |
| 7,730,899 | B2 | 6/2010 | Mai | |
| 7,735,547 | B2 | 6/2010 | Telfer | |
| 7,753,114 | B1 | 7/2010 | Penisson | |
| 7,753,124 | B1 | 7/2010 | Penisson | |
| D632,309 | S | 2/2011 | Coyle, Jr. | |
| 7,892,360 | B2 | 2/2011 | Mai | |
| 7,992,636 | B2 | 8/2011 | Telfer | |
| 8,066,817 | B2 | 11/2011 | Mai | |
| 8,162,064 | B1 | 4/2012 | Penisson | |
| 8,163,099 | B2 | 4/2012 | Mai | |
| 8,220,532 | B2 | 7/2012 | Hagen | |
| 8,298,428 | B2 | 10/2012 | Hagen | |
| 8,336,626 | B2 | 12/2012 | Hern et al. | |
| 8,353,349 | B2 | 1/2013 | Hern et al. | |
| 8,356,670 | B2 | 1/2013 | Telfer | |
| 8,408,307 | B2 | 4/2013 | Telfer | |
| 8,453,724 | B2 | 6/2013 | Zhou | |
| 8,511,375 | B2 | 8/2013 | Hern et al. | |
| 8,672,025 | B2 | 3/2014 | Wolf et al. | |
| 8,672,035 | B2 | 3/2014 | Telfer | |
| 8,678,091 | B2 | 3/2014 | Nelson et al. | |
| 8,689,877 | B2 | 4/2014 | Telfer et al. | |
| 8,714,260 | B2 | 5/2014 | Knobloch et al. | |
| 8,800,660 | B2 | 8/2014 | Fishbeck et al. | |
| 8,844,622 | B2 | 9/2014 | Telfer | |
| 8,955,584 | B2 | 2/2015 | Telfer | |
| 9,109,417 | B2 | 8/2015 | Leiper et al. | |
| 9,260,941 | B2 | 2/2016 | Linklater | |
| 2005/0205251 | A1 | 9/2005 | Tulloch et al. | |
| 2005/0274524 | A1 * | 12/2005 | Silguero | E21B 31/06 166/311 |
| 2006/0042790 | A1 | 3/2006 | Ruttley | |
| 2006/0207796 | A1 | 9/2006 | Stewart | |
| 2007/0085645 | A1 | 4/2007 | Ruttley | |
| 2007/0267196 | A1 | 11/2007 | Mondelli et al. | |
| 2009/0211816 | A1 | 8/2009 | Williams | |
| 2010/0096122 | A1 * | 4/2010 | Posevina | E21B 37/00 166/173 |
| 2010/0181064 | A1 | 7/2010 | Knobloch et al. | |
| 2010/0186962 | A1 | 7/2010 | Knobloch et al. | |
| 2010/0243258 | A1 | 9/2010 | Fishbeck et al. | |
| 2011/0168383 | A1 | 7/2011 | Davis et al. | |
| 2011/0186287 | A1 | 8/2011 | Davis et al. | |
| 2011/0271470 | A1 | 11/2011 | Hern et al. | |
| 2011/0284210 | A1 | 11/2011 | Hern et al. | |
| 2011/0284211 | A1 * | 11/2011 | Hern | E21B 17/1078 166/99 |
| 2012/0029702 | A1 | 2/2012 | Tverlid | |
| 2012/0241145 | A1 | 9/2012 | Knobloch et al. | |
| 2015/0122480 | A1 | 5/2015 | Sullivan et al. | |

FOREIGN PATENT DOCUMENTS

| | | | |
|---|---|---|---|
| JP | 2008178801 | A | 8/2008 |
| KR | 2013 0023968 | A | 3/2013 |
| WO | 2011022453 | A1 | 2/2011 |

OTHER PUBLICATIONS

Canadan Office Action dated Nov. 17, 2015, for Canadian Patent Application No. 2,869,299.

Canadian Office Action dated Sep. 9, 2016, for Canadian Patent Application No. 2,869,299.

Australian Examination Report dated Aug. 13, 2015, for Australian Application No. 2014256426.

Australian Examination Report dated Jul. 29, 2016, for Australian Application No. 2014256426.

EPO Extended European Search Report dated Mar. 26, 2015, for European Application No. 14191364.0.

EPO Office Action dated Apr. 23, 2018, for European Application No. 14191364.0.

GCC Examination Report dated Feb. 19, 2018, for GCC Application No. GC 2014-28251.

* cited by examiner

MAGNETIC RETRIEVAL APPARATUS

CROSS-REFERENCE TO RELATED APPLICATIONS

This application claims benefit of U.S. provisional patent application Ser. No. 61/900,206, filed Nov. 5, 2013, which patent application is herein incorporated by reference in its entirety.

BACKGROUND OF THE INVENTION

Field of the Invention

Embodiments of the invention generally relate to apparatus and methods for removing material from a wellbore. Particularly, embodiments of the invention relate to a magnetic retrieval apparatus. Embodiments of the invention also relate to apparatus and methods of assembling a magnetic retrieval apparatus.

Description of the Related Art

Many operations in an oil or gas well often produce a variety of debris in the wellbore. For example, milling operations may produce metallic mill cuttings, which may not be completely removed by circulation of fluid in the wellbore. Also, bit cones, slips, tong pins, and hammers, or fragments thereof, can collect at the bottom of the wellbore.

Retrieval tools containing magnets have been used to retrieve the debris in the wellbore. One type of retrieval tool includes a plurality of magnets disposed on its exterior, and the magnets may be exposed to the wellbore environment surrounding the retrieval tool. The exposed magnets are subjected to physical damage or corrosion in the wellbore, and in some instances, may even be lost in the wellbore.

The handling of magnets during assembly of the retrieval tool raises safety concerns. Large, high strength magnets may be pulled out of the operator's hand by an adjacent magnet.

There is a need, therefore, for an improved retrieval tool for retrieving debris from the wellbore. There is also a need for apparatus and methods of assembling a retrieval tool.

SUMMARY OF THE INVENTION

In one embodiment, a downhole retrieval tool includes a mandrel; an inner sleeve disposed around the mandrel; a plurality of magnets coupled to the inner sleeve; and an outer sleeve disposed around the plurality of magnets, wherein the inner sleeve and the plurality of magnets are rotatable relative to the mandrel.

In another embodiment, a method of assembling a downhole retrieval tool includes providing an assembly tool having an anchor, a conveyance, and a holder; disposing an inner sleeve around a mandrel; coupling the anchor to the inner sleeve; using the holder to retain a magnet; operating the conveyance to move the magnet to a desired location on the inner sleeve; attaching the magnet to the inner sleeve; and moving the holder away from the magnet.

In another embodiment, an assembly tool for handling a magnet includes an anchor; a conveyance movable relative to the anchor; and a magnet holder coupled to the conveyance, wherein the magnet holder includes an arm for retaining the magnet.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
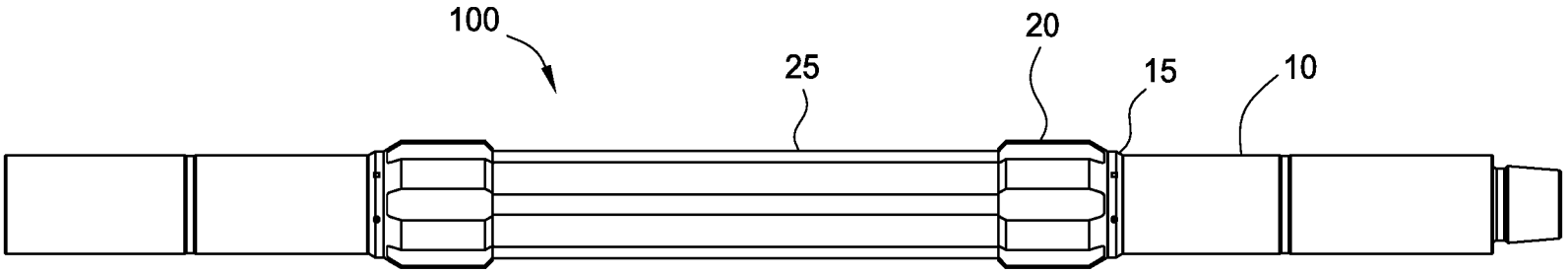
FIG. 1 is a perspective view of an exemplary embodiment of a retrieval tool 100.
Figure 1A:
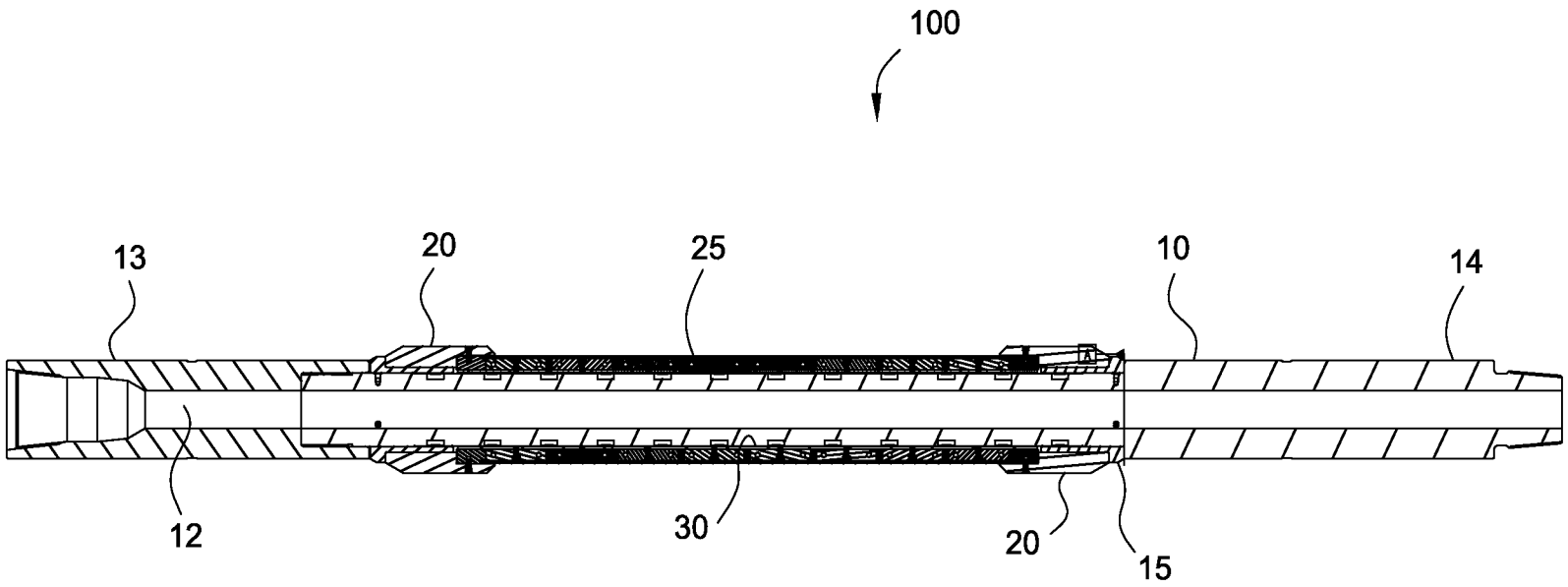
FIG. 1A is a cross-sectional view of the retrieval tool.
Figure 2:
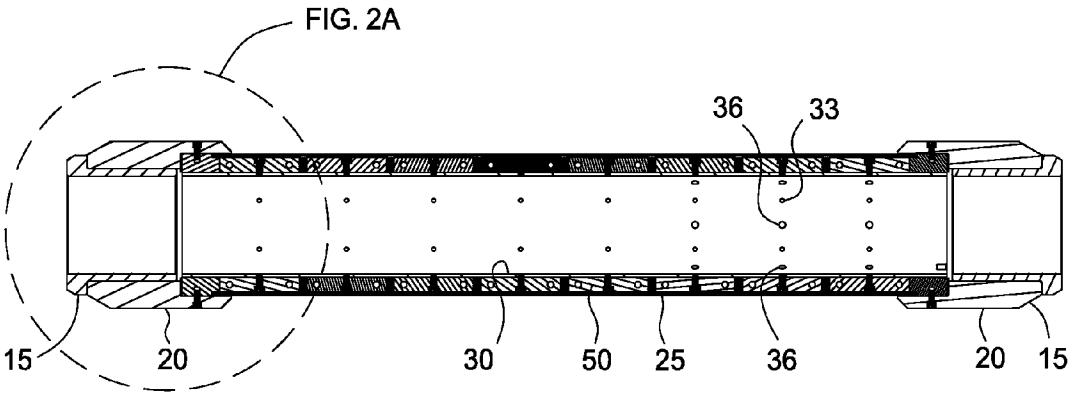
FIG. 2 is an enlarged cross-sectional view of the retrieval tool without the mandrel.
Figure 2A:
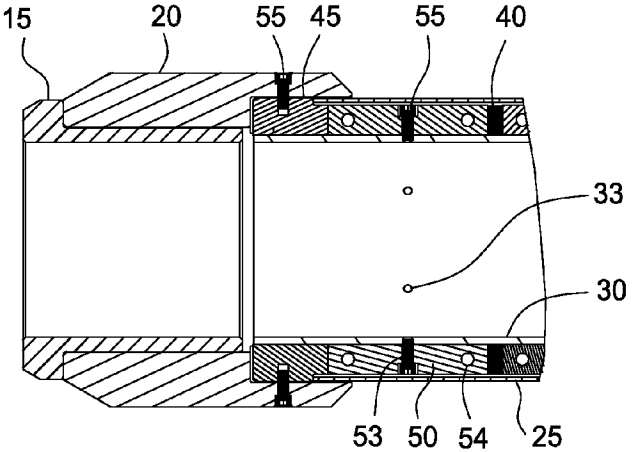
FIG. 2A is an enlarged, partial view of FIG. 2.
Figure 3:
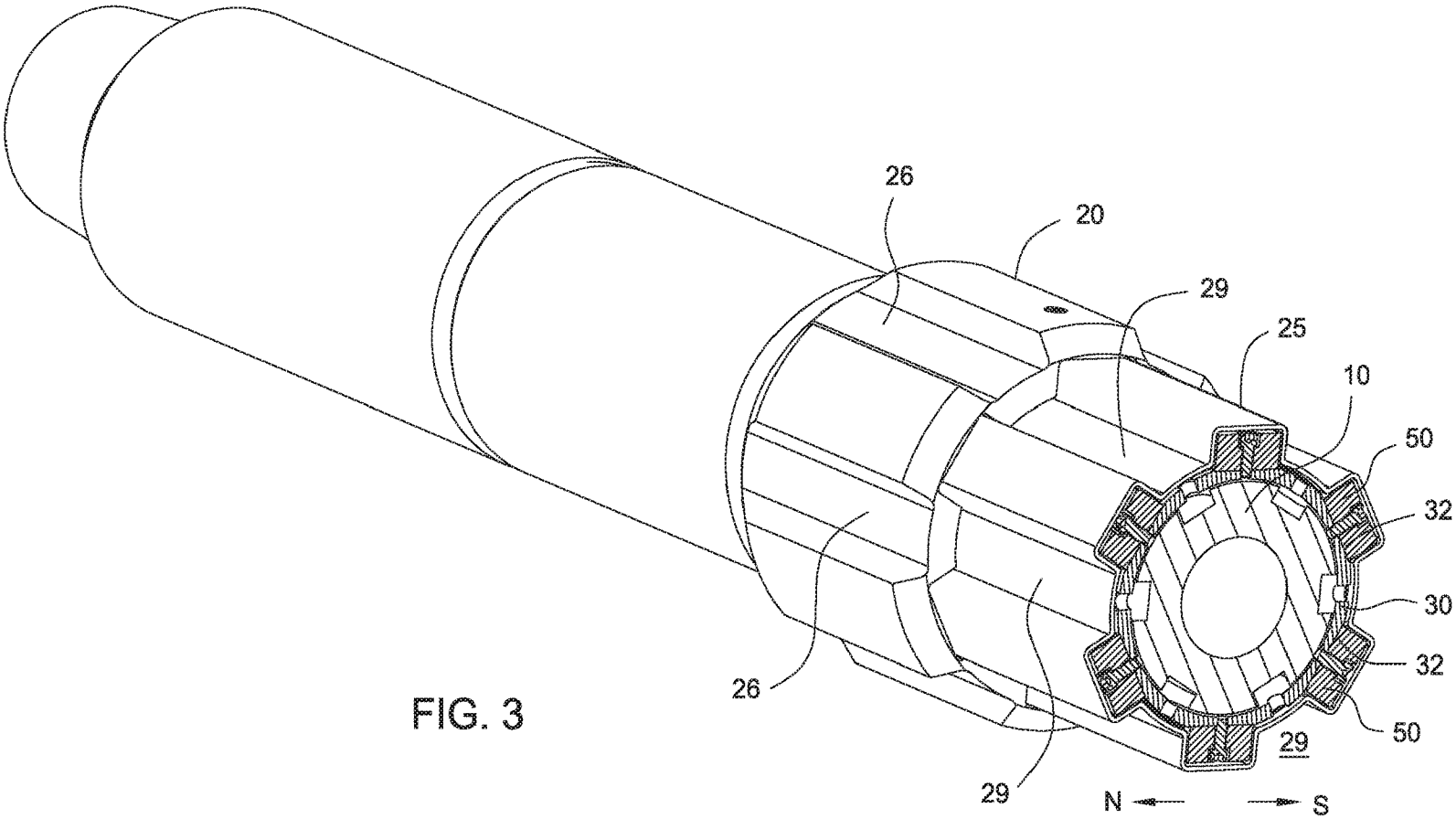
FIG. 3 is another cross-sectional view of the retrieval tool.
Figure 4:
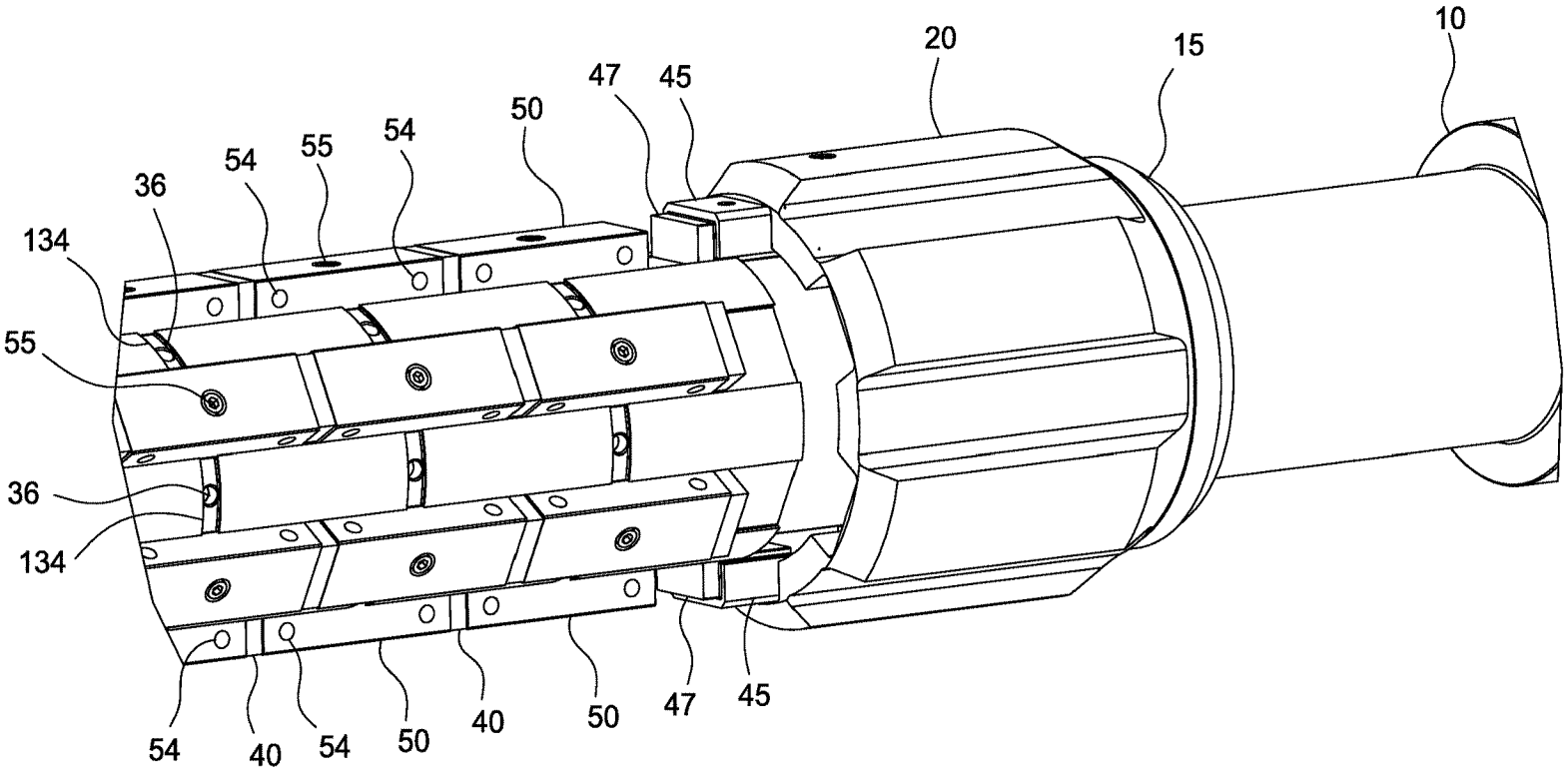
FIG. 4 is a partial, perspective view of the retrieval tool.

FIG. 1 is a perspective view of an exemplary embodiment of a retrieval tool 100. FIG. 1A is a cross-sectional view of the retrieval tool 100. FIG. 2 is an enlarged cross-sectional view of the retrieval tool 100 shown without the mandrel, and FIG. 2A is an enlarged, partial view of FIG. 2. FIG. 3 is another cross-sectional view of the retrieval tool 100. FIG. 4 is a partial, perspective view of the retrieval tool 100. As shown in these Figures, the retrieval tool 100 is a magnetic retrieval tool suitable for retrieving metallic debris from the wellbore. The retrieval tool 100 includes a mandrel 10 having a central bore 12 and upper and lower ends 13, 14 adapted for connection to a work string or other downhole tools.

Figure 4A:
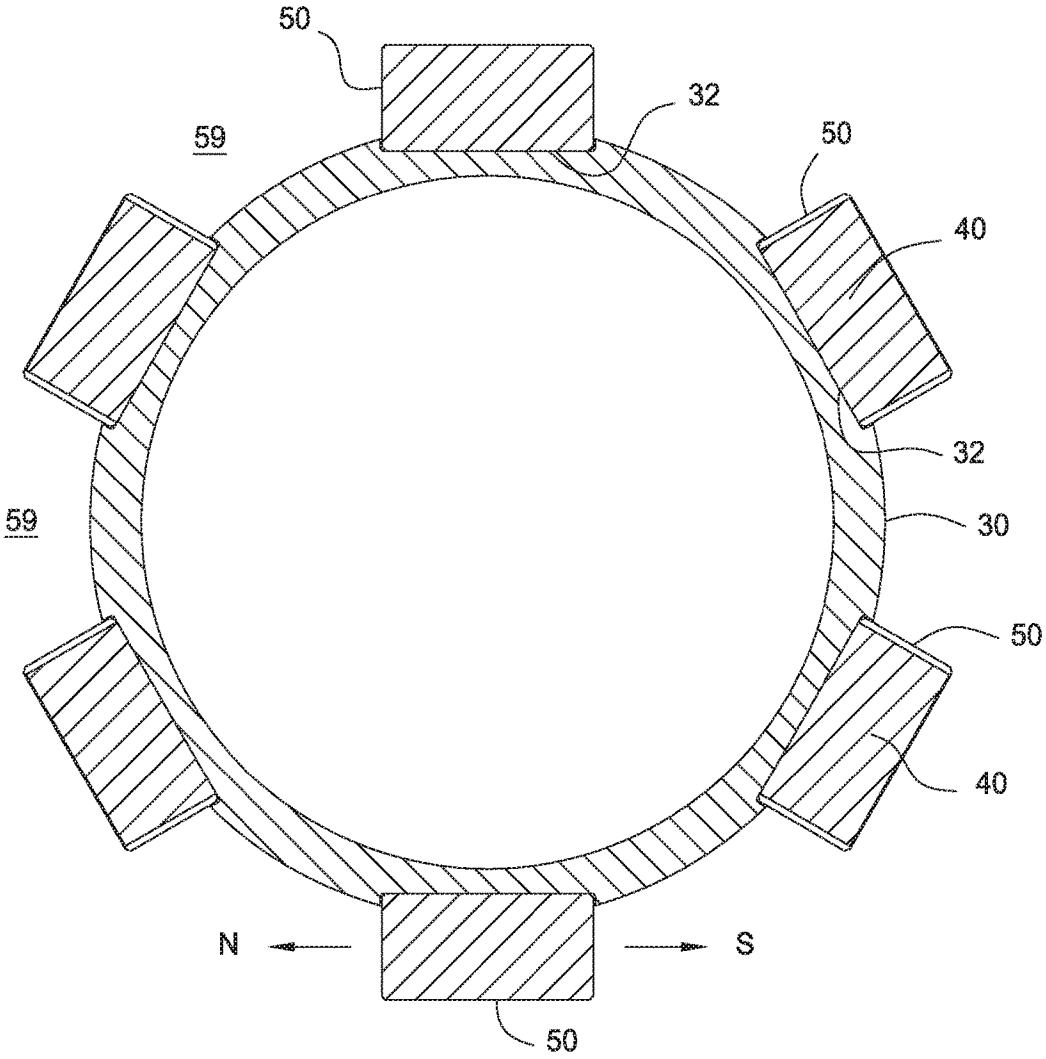
FIG. 4A is a cross-sectional view of the retrieval tool of FIG. 4.

Referring now to FIGS. 2, 2A, and 3 an inner sleeve 30 is disposed around the mandrel 10. The inner sleeve 30 includes a plurality of circumferentially spaced axial channels 32 for receiving a plurality of magnets 50, as shown in the cross-sectional views of FIGS. 3 and 4A. The inner sleeve 30 may include any suitable number of axial channels 32, such as six channels or between two to eight channels, or more. The channels 32 may be recessed to help prevent the magnets 50 from moving circumferentially toward an adjacent magnet 50. A plurality of apertures 33 may be formed in the axial channels 32 for mating with a fastener 55 for retaining the magnet 50 in position. For example, the aperture 33 may be a configured to mate with a bolt 55. Optionally, a non-metallic spacer 40 may be disposed between two adjacent magnets 50 in a channel 32. In FIG. 4A, a spacer 40 is disposed in front of some of the magnets 50. The spacer 40 may be attached to the magnet 50 or the inner sleeve 30 using an adhesive, a fastener, or any other suitable mechanisms. As will be described below and shown in FIG. 4, the inner sleeve 30 may optionally include a plurality of assembly apertures 36 disposed between two adjacent channels 30. The assembly apertures 36 may be formed in a circumferential slot 134 on the inner sleeve 30. In one embodiment, two columns of assembly apertures 36 are formed at 180 degrees from each other along the inner sleeve 30. The assembly apertures 36 may be used to hold the assembly tool 200 in place during assembly.

Figure 5:
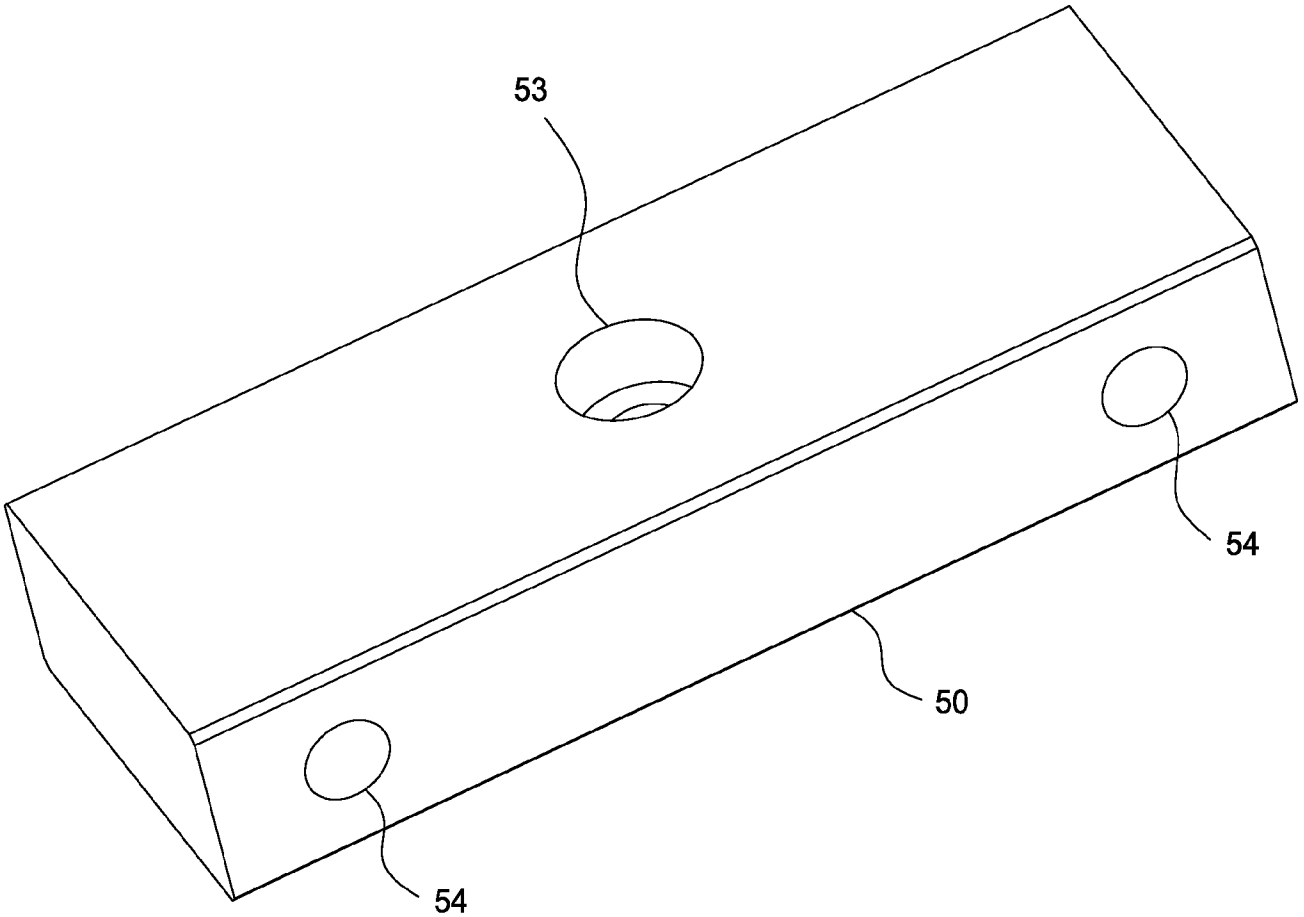
FIG. 5 illustrates an exemplary embodiment of a magnet.

FIG. 5 illustrates an exemplary embodiment of a magnet 50. The magnet 50 may have a rectangular shape. The width of the magnet 50 is sized to fit within the channel 32 on the inner sleeve 30, and the height may be taller than the channel 32. If the magnets 50 protrude from the channel 32, the space between two adjacent columns of magnets 50 may be referred to as the "valley" 59, as shown in FIG. 4A. The magnet 50 may have any suitable length. In one example, the magnet 50 has a length between 3 and 5 inches, a width between 1 and 2 inches, and a height between 0.5 and 1 inches. In another example, the magnet 50 has a length between 1 and 8 inches, a width between 0.5 and 4 inches, and a height between 0.25 and 2 inches. The magnet 50 may have one or more apertures 53 through the top surface for receiving the fastener 55 that will mate with the aperture 33 in the inner sleeve 30. As shown, the magnet 50 is provided with one aperture 53, which optionally includes a countersink in the aperture 53. In one embodiment, the sides of magnet 50 may include a plurality of retainer bores 54 for receiving a retainer of the assembly tool 200, as will be described below. Although two retainer bores 54 are shown, it is contemplated that the magnet 50 may include any suitable number of retainer bores 54, such as one, three, or four. It is further contemplated that the number of the retainers used may be less than or equal to the number of retainer bores 54. For example, only one retainer, such as a pin, is used even if two bores 54 are present.

In one embodiment, the "north" pole and the "south" pole of the magnet are oriented on either the left side or the right side of the magnet. For example, as shown in FIGS. 3 and 4A, the north pole may be on the left side and the south pole may be on the right side of the magnet 50. In use, this north and south arrangement maximizes the collection of debris in the valley 59 between two columns of magnets 50.

The retrieval tool 100 may include a housing sleeve 25 disposed around the magnets 50 and the inner sleeve 30. The housing sleeve 25 may conformed to the contour of the retrieval tool 100 formed by the magnets 50 and the inner sleeve 30. In one example, the housing sleeve 25 may have an outer shape that is complementary to the outer shape of the magnets 50 on the inner sleeve 30. In this respect, the housing sleeve 25 includes valleys 29 that are aligned with the valleys 59 between adjacent columns of magnets 50.

Figure 6:
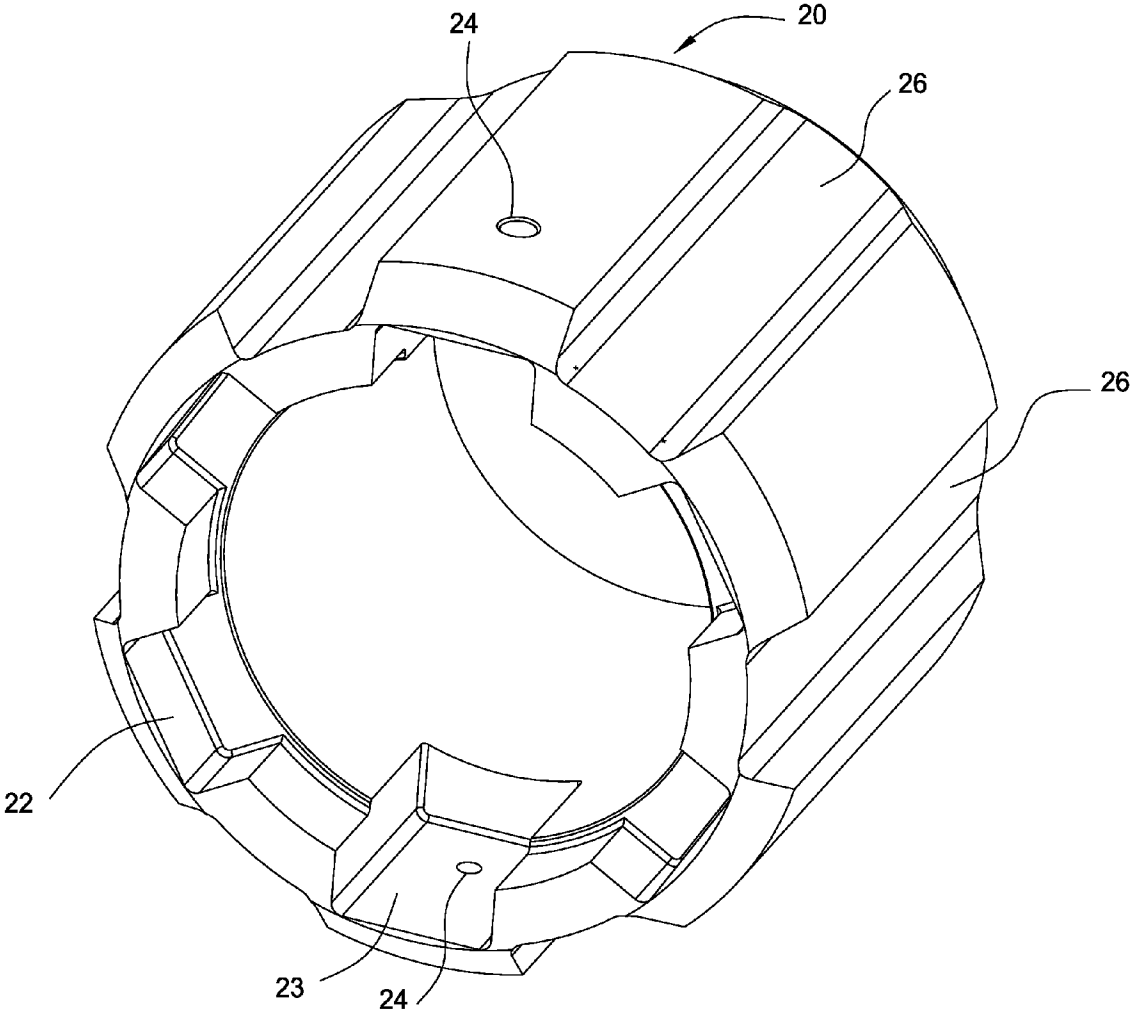
FIG. 6 illustrates an exemplary embodiment of a stabilizer.

A stabilizer 20 may be disposed at each end of the inner sleeve 30. Referring to FIGS. 2, 4, and 6, the stabilizer 20 may have an outer diameter that is larger than the outer diameter of the housing sleeve 25. In one embodiment, at least a portion of the inner diameter of stabilizer 20 has an inner recess 22 that complements the outer profile of the housing sleeve 25. The outer shape of the stabilizer 20 may include a valley 26 that is aligned with a valley 29 of the housing sleeve 25, as shown in FIG. 3. One or more keys 45 may be disposed on an axial channel 32 and adapted to engage a groove 23 in the stabilizer 20. As shown, two keys 45 are used at each stabilizer 20. A fastener 55 such as a bolt may be inserted through an aperture 24 to fasten the stabilizer 20 to the key 45. In this respect, the inner sleeve 30, magnets 50, outer sleeve 25, and the stabilizer 20 may be rotatable with each other. In one embodiment, the keys 45 may have a recess 47 to receive the housing sleeve 25, and may be used to limit axial movement of the housing sleeve 25 relative to the magnets 50. In another embodiment, a bearing 15 may be disposed between stabilizer 20 and the mandrel 10.

Figure 7A:
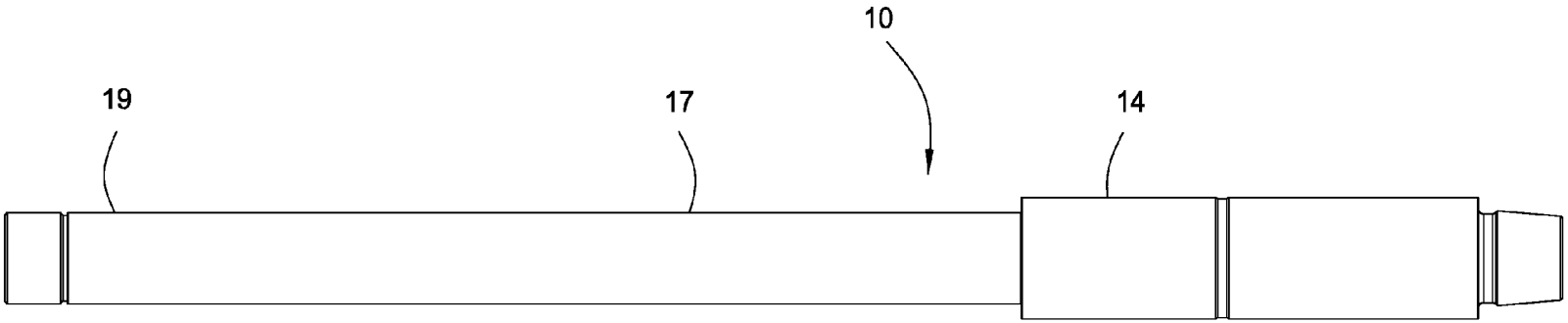
FIGS. 7A-7G are sequential views of the initial steps of an exemplary process of assembling a retrieval tool.
Figure 7B:
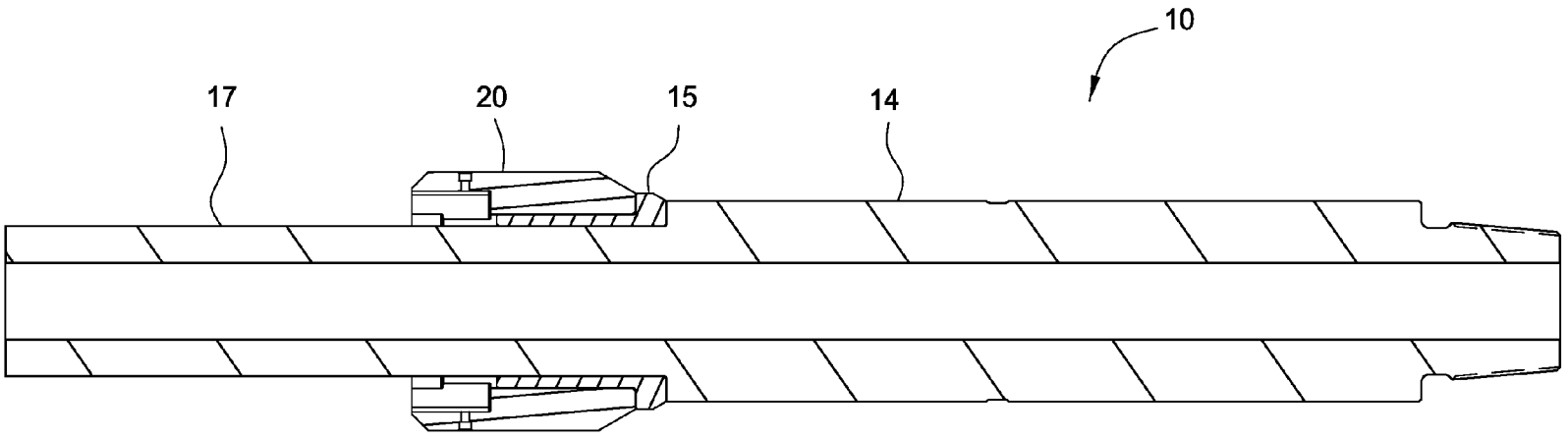

Assembly of the retrieval tool 100 will now be described. FIG. 7A is a perspective view of an exemplary mandrel 10 with a lower end 14 and a recessed portion 17. During installation of the magnets 50, the upper end 13 is removed to expose a recessed end 19 on the mandrel 10. FIG. 7B shows a bearing 15 and a stabilizer 20 disposed proximate a lower end 14 of the mandrel 10. In this embodiment, the bearing 15 and the stabilizer 20 are disposed in the recessed portion 17 of the mandrel 10. The bearing 15 and the stabilizer 20 may be inserted onto the recessed portion 17 from the recessed end 19 of the mandrel 10.

Figure 7C:
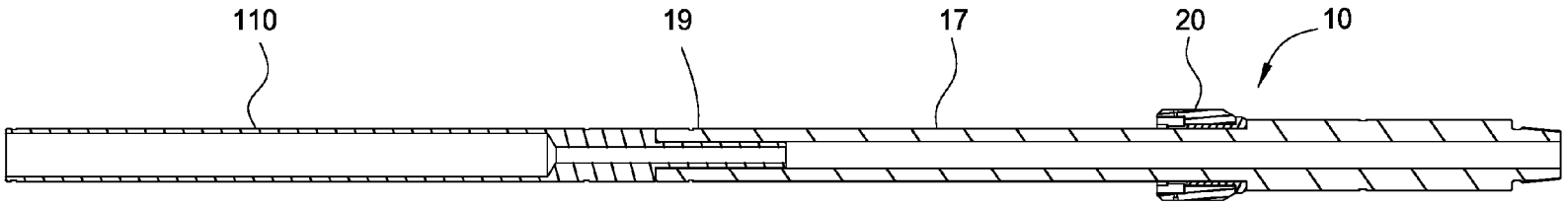

In FIG. 7C, an extension mandrel 110 is temporarily attached to the recessed end 19 of the mandrel 10. The extension mandrel 110 may be used to facilitate assembly of the magnets 50 on the retrieval tool 100. The extension mandrel 110 has an outer diameter that is substantially the same as the outer diameter of the recess portion 17 of the mandrel 10.

Figure 7D:
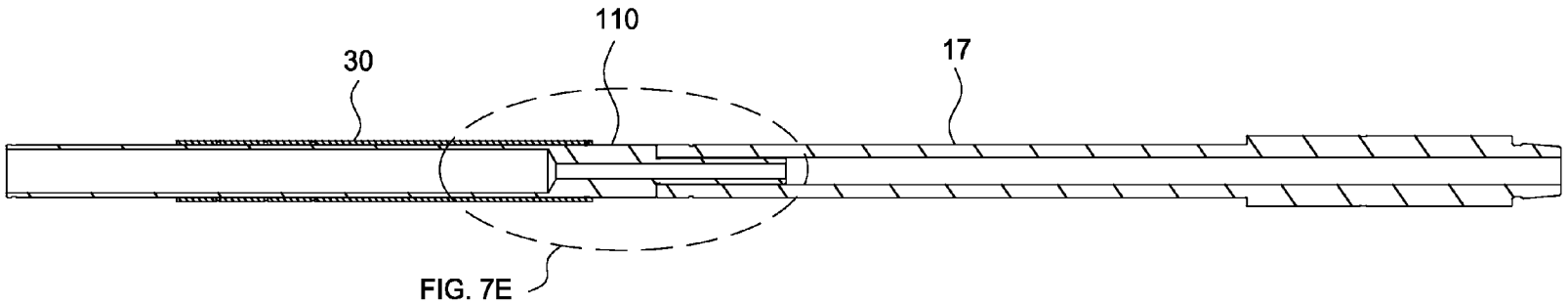
Figure 7E:
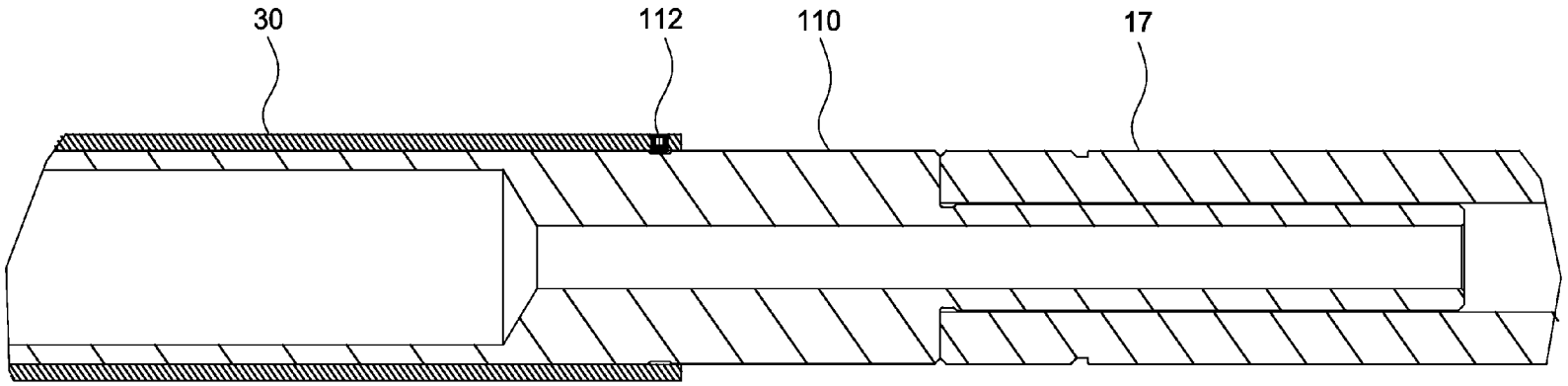
Figure 7F:
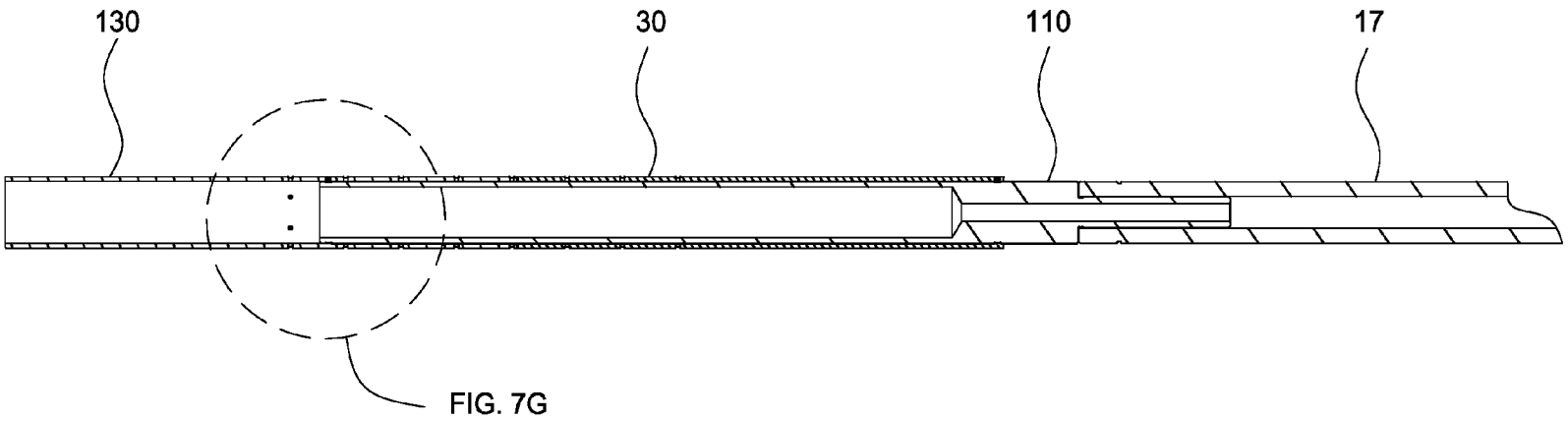
Figure 7G:
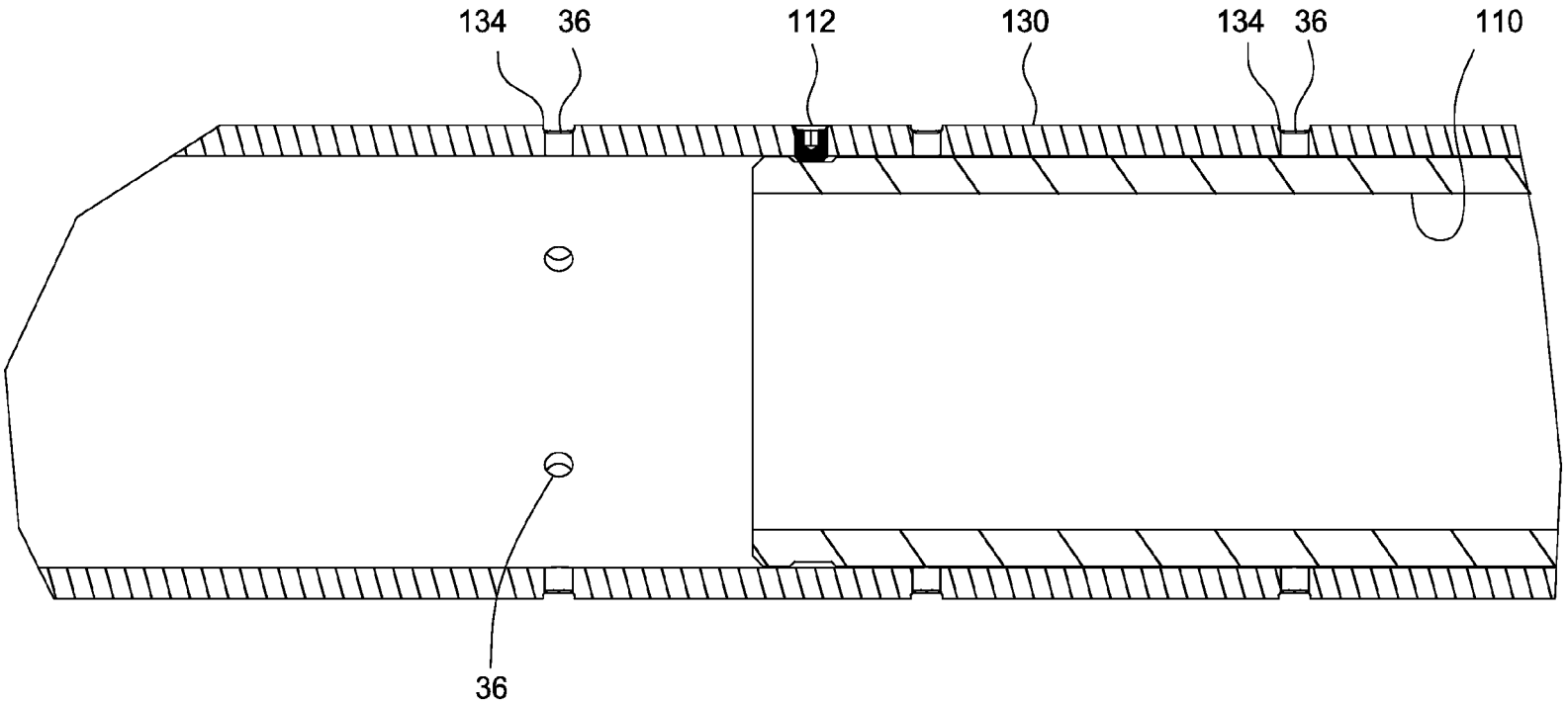

In FIG. 7D, the inner sleeve 30 is positioned around the extension mandrel 110. As shown in FIG. 7E, which is an enlarged partial view of FIG. 7D, a fastener 112 such as a bolt or pin is used to attach the inner sleeve 30 to the extension mandrel 110. In FIG. 7F, an extension sleeve 130 is positioned around the extension mandrel 110 and adjacent the inner sleeve 30. The extension sleeve 130 includes channels 132 that are placed in alignment with the channels 32 of the inner sleeve 30. FIG. 7G is an enlarged partial view of FIG. 7F. FIG. 7G shows another fastener 112 is used to temporarily attach the extension sleeve 130 to the extension mandrel 110. A plurality of circumferential slots 134 are formed on the exterior of the inner sleeve 30 and the extension sleeve 130. The assembly apertures 36 are formed through the slots 134. FIG. 4 shows a perspective view of the slots 134 and assembly apertures 36 on the inner sleeve 30.

Figure 8:
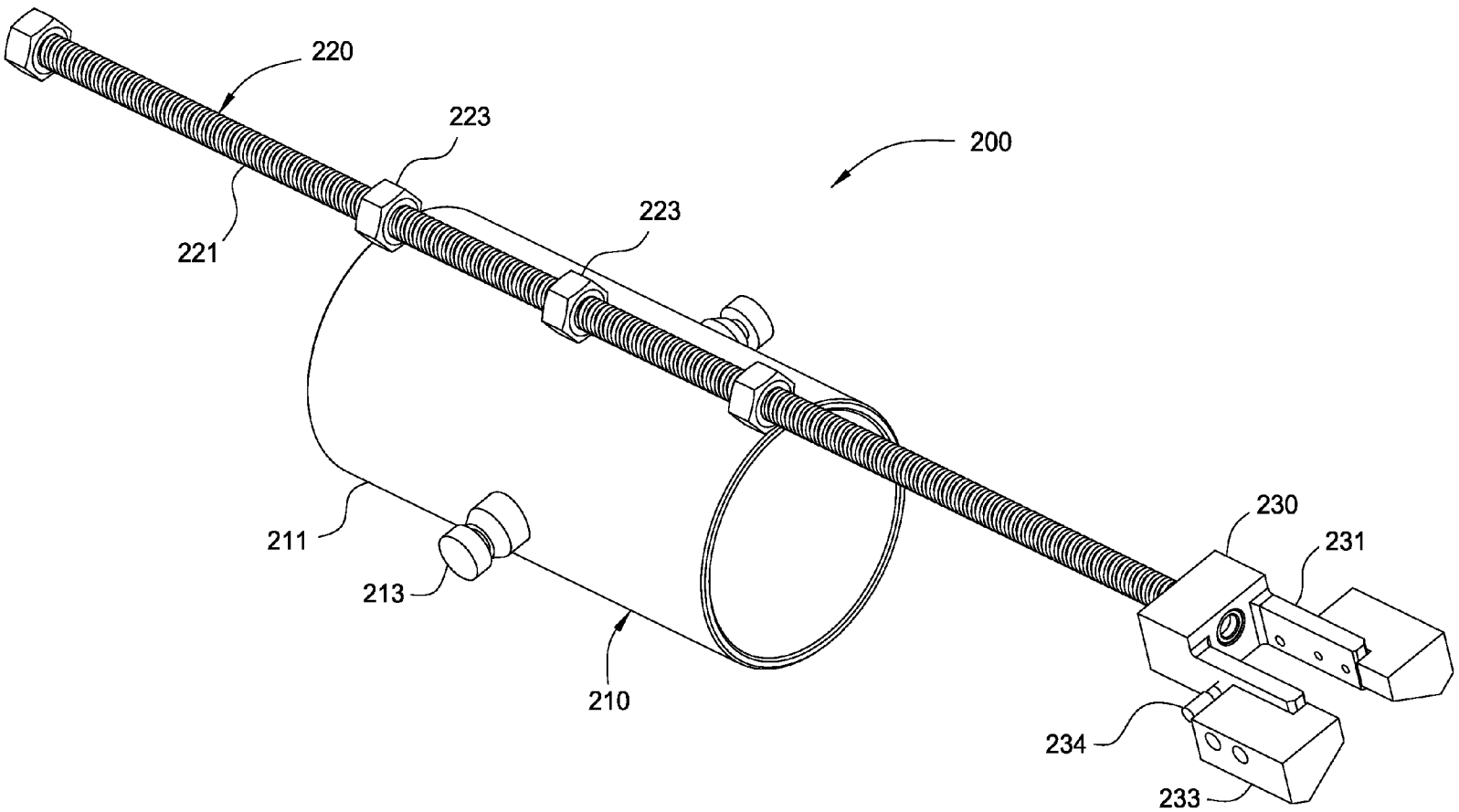
FIG. 8 illustrate an exemplary embodiment of an assembly tool.

FIG. 8 illustrates an exemplary embodiment of the assembly tool 200. The assembly tool 200 includes an anchor 210, a conveyance 220, and a holder 230. The anchor 210 includes a collar 211 and a locking device 213. The collar 211 is configured to be disposed around the inner sleeve 30 and the extension sleeve 130. The locking device 213 may include a retractable pin configured to mate with the assembly aperture 36 in the slots 134. A plurality of locking devices 213 may be used. As shown, the anchor 210 includes two locking devices 213. It is contemplated that the locking device 213 may be any releasable locking device suitable for attaching the anchor 210 to the inner sleeve 30 and the extension sleeve 130, for example, bolts, latches, pins, or dogs. The locking device 213 may be biased in the engaged positioned using, for example, a spring.

The conveyance 220 is configured to extend or retract the holder 230. In one embodiment, the conveyance 220 is movable relative to the anchor 210. The conveyance 220 may be a rod 221 configured to mate with one or more couplers 223 attached to the collar 211. In one example, the rod 221 is threadedly coupled to the coupler 223. In this respect, rotation of the rod 221 will move the rod 221 relative to the collar 211. In one example, the coupler 223 is a nut, and three couplers 223 are used to couple the rod 221 to the collar 211. The rod 221 may be rotated manually or using a motor. In another example, gears may be used to move the conveyance 220 relative to the collar 211. In yet another embodiment, the rod 221 may be coupled to the coupler 223 using splines, and may be moved manually, or using a mechanical device such as a motor or a piston.

The holder 230 is coupled to and movable by the conveyance 220. The holder 230 includes two retaining arms 231 configured to retain a magnet between the arms 231. An optional guide member 233 may be disposed on the exterior of the arms 231. The guide member 233 is configured to prevent movement of the holder 230 toward an adjacent magnet. In one embodiment, the guide member 233 is sized to contact or nearly contact the adjacent magnet. The guide member 233 may be attached to the arm 231 using a pin, a screw, adhesive, or any suitable mechanism known to a person skilled in the art. The arms and/or the guide member may be made of a non-metallic material. In another embodiment, the guide member 233 may be integral with the arms 231. Any suitable releasable retainer may be used to couple the magnet to the holder 230. In one example, a pin 234 may be inserted through one of the arms 231 and the retainer bore 54 of the magnet 50.

Figure 9:
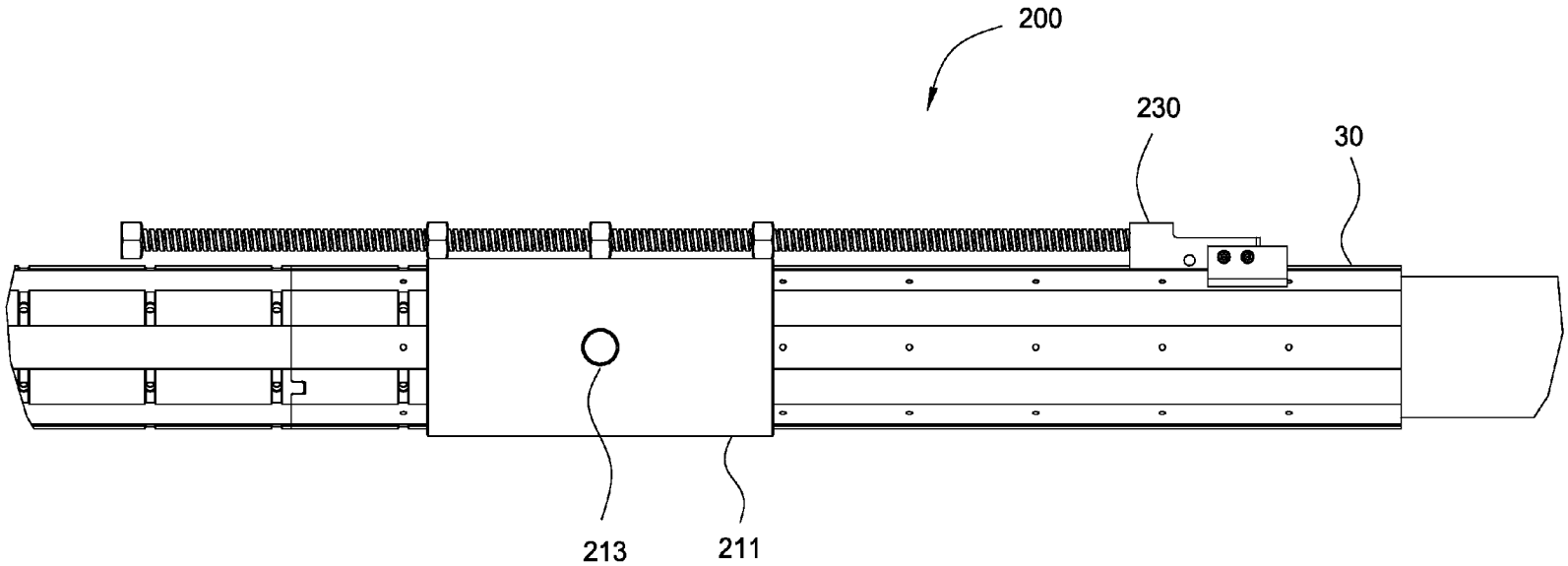
FIGS. 9, 9A, and 9B show a step of assembling a retrieval tool, wherein the assembly tool of FIG. 8 installed on the inner sleeve.
Figure 9A:
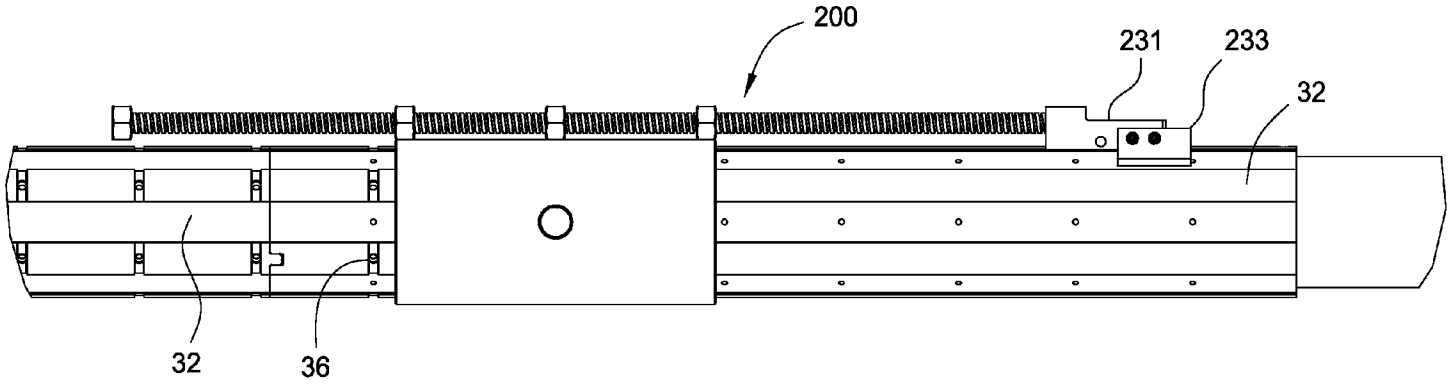
Figure 9B:
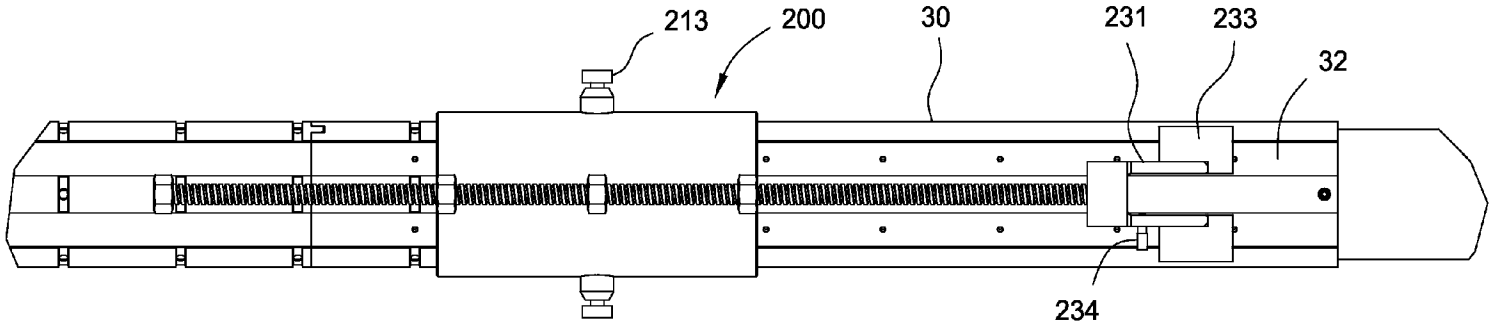

FIG. 9 shows the assembly tool 200 installed on the inner sleeve 30 to begin the magnet assembly process. As shown, the collar 211 is disposed around the inner sleeve 30 and the locking device 213 is engaged with an assembly aperture 36 in the inner sleeve 30. FIG. 9A is an enlarged side view of the assembly tool 200 in FIG. 9. It can be seen that one side of the guide member 233 is aligned with an adjacent channel 32. FIG. 9B is an enlarged top view of the assembly tool 200 in FIG. 9. It can be seen the two arms 231 are aligned with edges of the channel 32 receiving the magnet.

Figure 10:
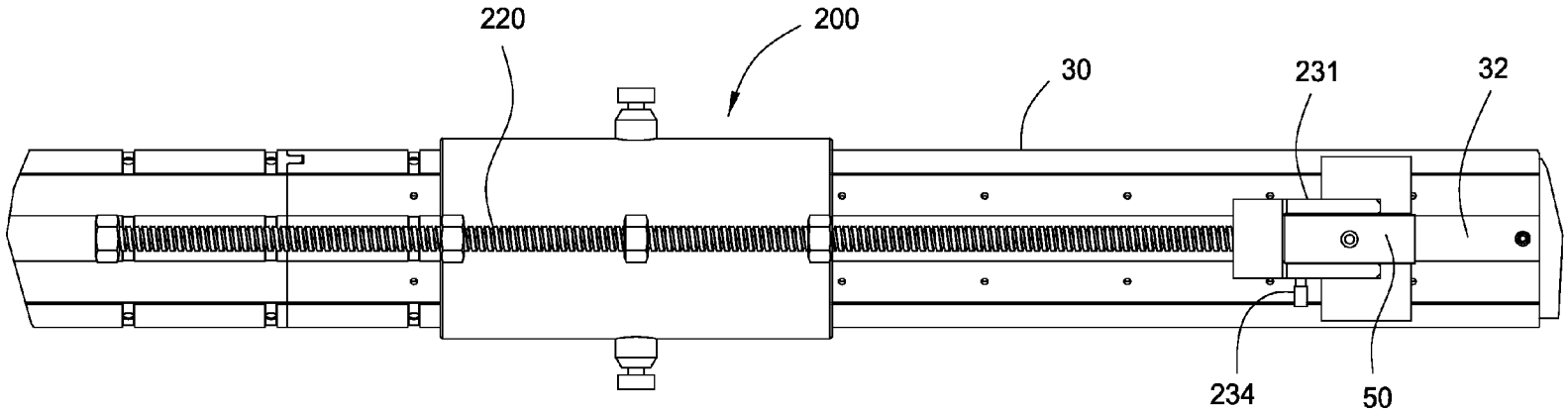
FIG. 10 shows a step of assembling a retrieval tool, wherein a magnet positioned in the assembly tool.

In FIG. 10, a magnet 50 is positioned between the arms 231 of the assembly tool 200 and in a channel 32 of the inner sleeve 30. Also, the pin 234 is inserted into the retainer bore 54 of the magnet 50. The conveyance 220 is then rotated to move the magnet 50 along the channel 32 to the desired location on the inner sleeve 30.

Figure 11:
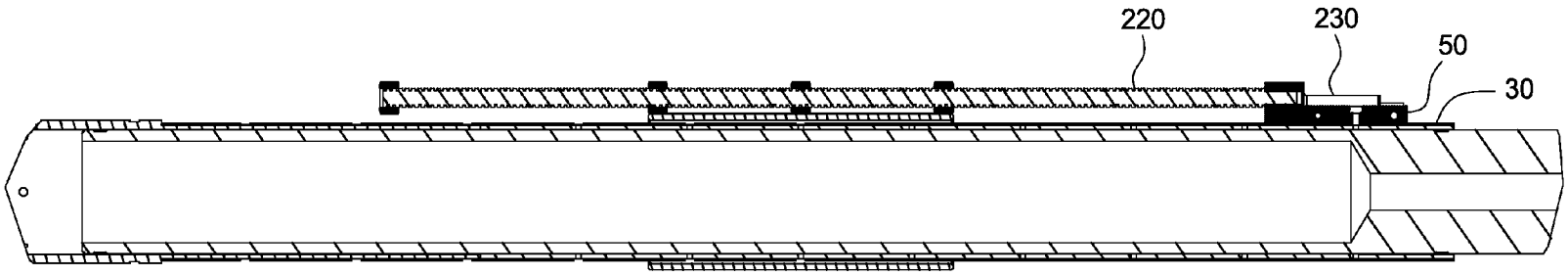
FIGS. 11 and 11A-11C show additional steps of assembling a retrieval tool, wherein the magnet is installed on the inner sleeve.
Figure 11A:
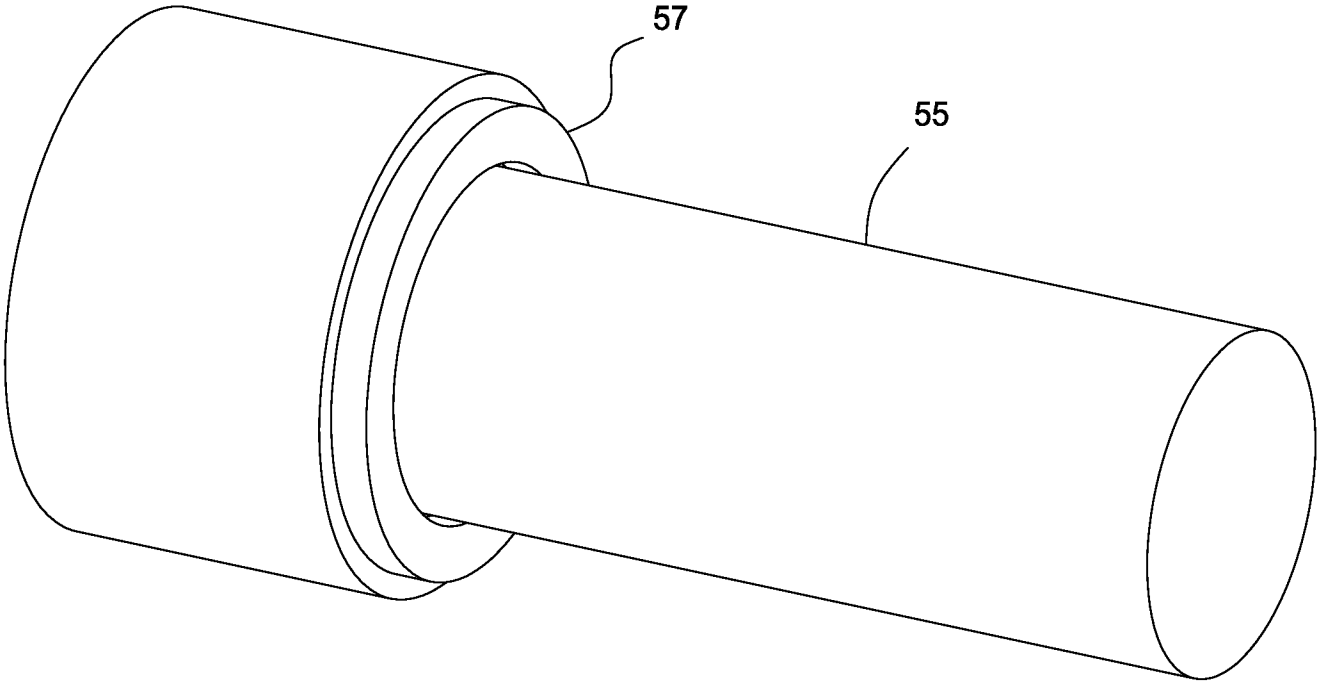
Figure 11B:
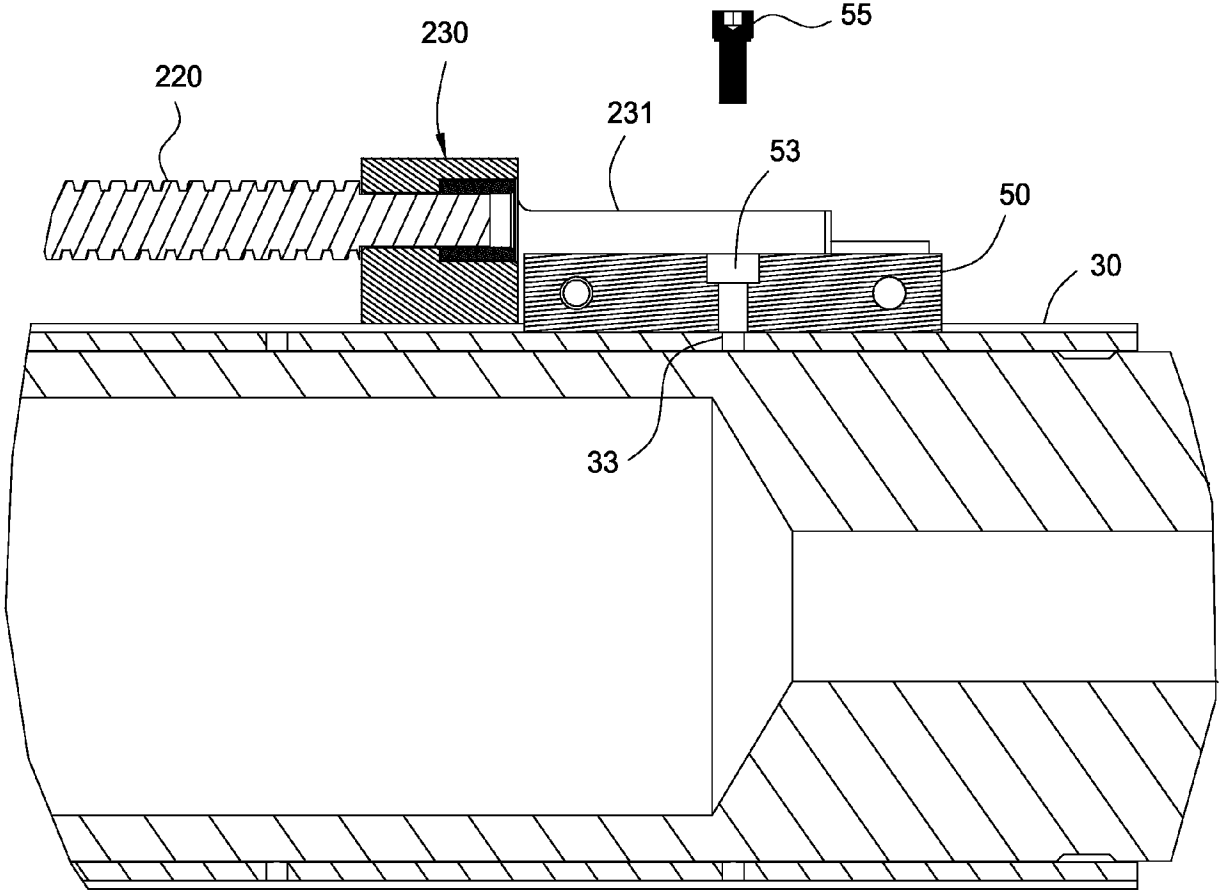
Figure 11C:
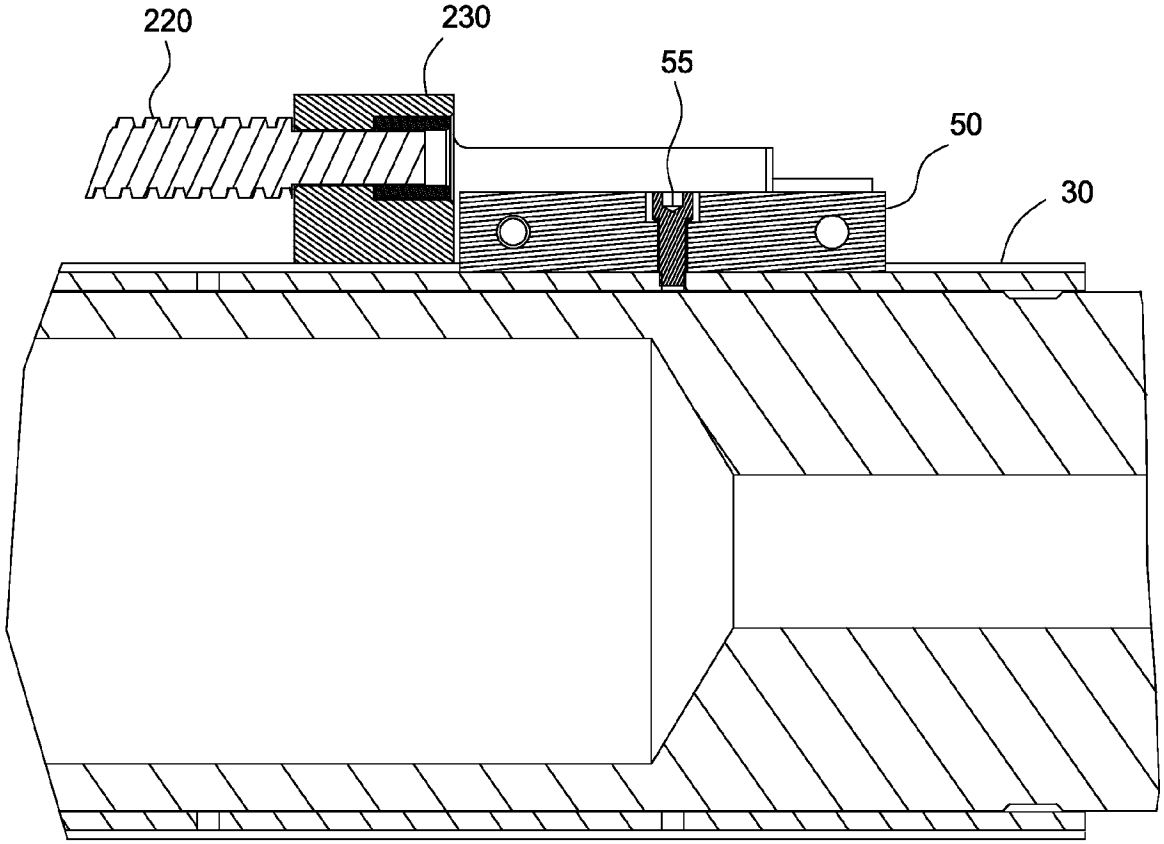

In FIG. 11, the magnet 50 has moved to the desired location, and the aperture 53 in the magnet 50 is aligned with the aperture 33 of the inner sleeve 30. Thereafter, a bolt 55 is used to attach the magnet 50 to the inner sleeve 30. FIG. 11A shows an exemplary embodiment of a bolt 55 and an optional washer 57. FIG. 11B is an enlarged view of the holder 230 and the magnet 50, just before the bolt 55 is inserted into the magnet 50 and the inner sleeve 30 via apertures 53, 33. FIG. 11C shows the magnet 50 after the bolt 55 has been inserted, thereby attaching the magnet 50 to the inner sleeve 30.

Thereafter, the pin 234 is released from the magnet 50, and the holder 230 is retracted from the magnet 50.

Figure 12:
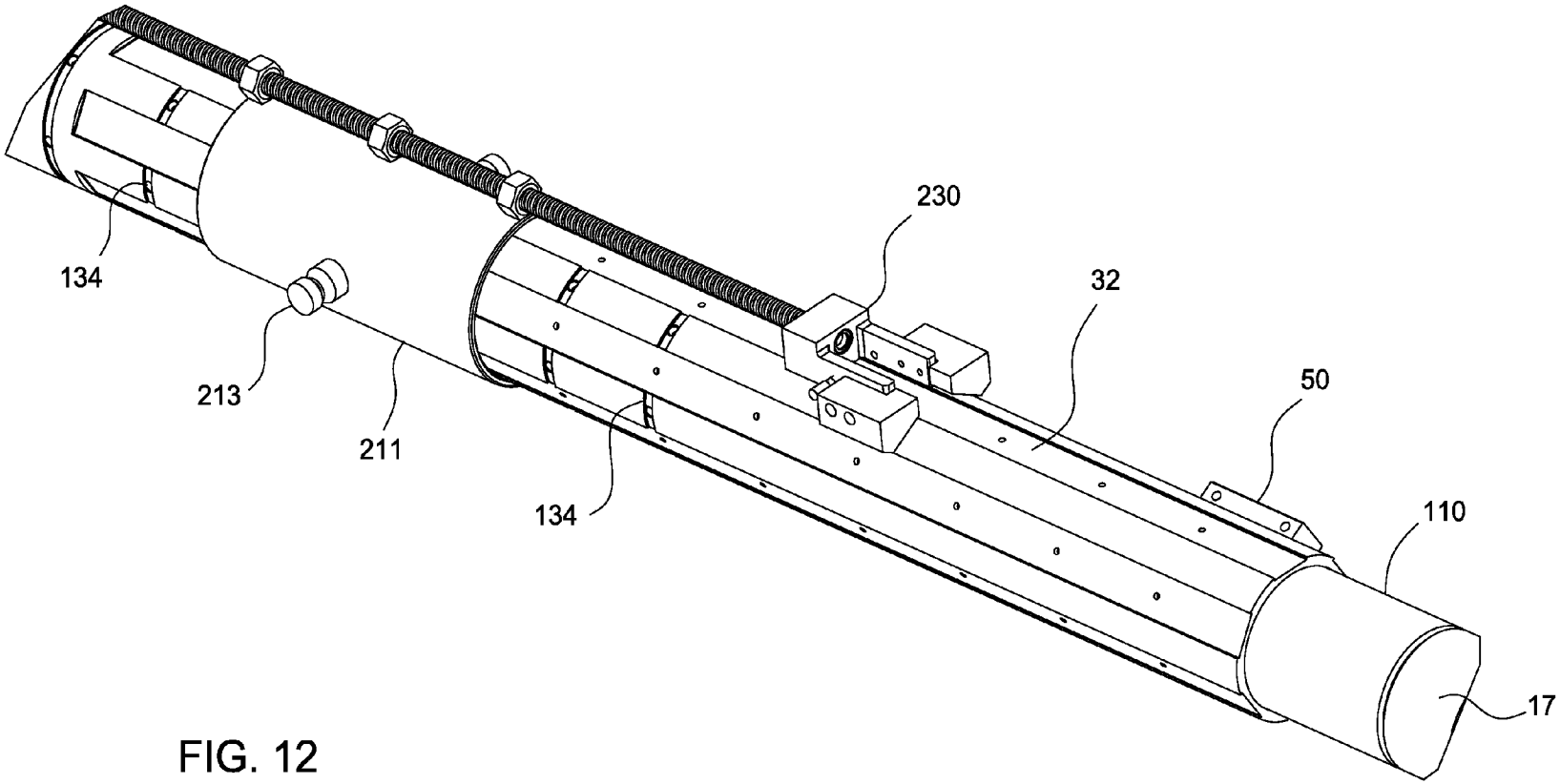
FIGS. 12 and 12A-12D show additional steps of assembling a retrieval tool, wherein additional magnets are installed on the inner sleeve.
Figure 12A:
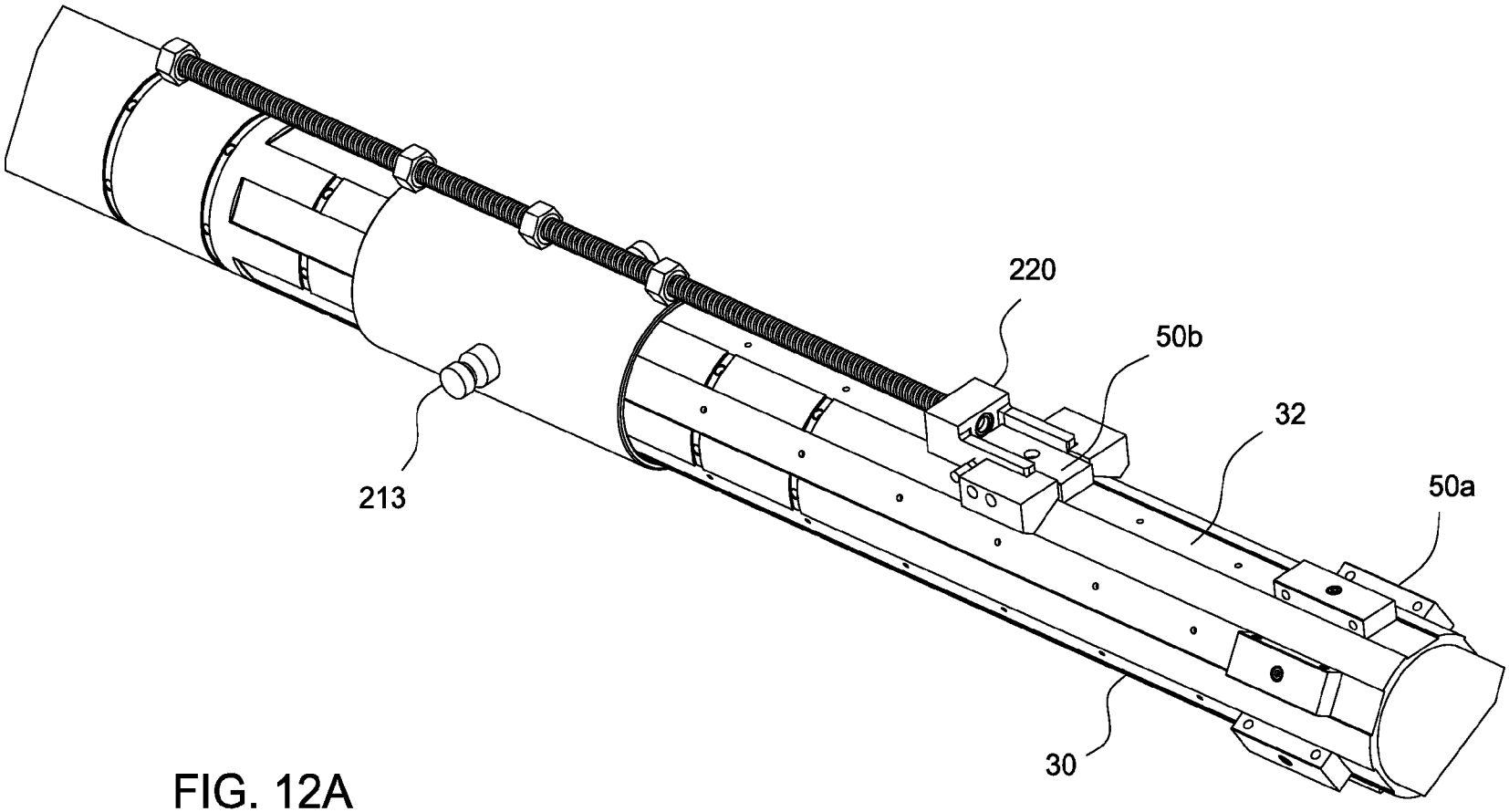
Figure 12B:
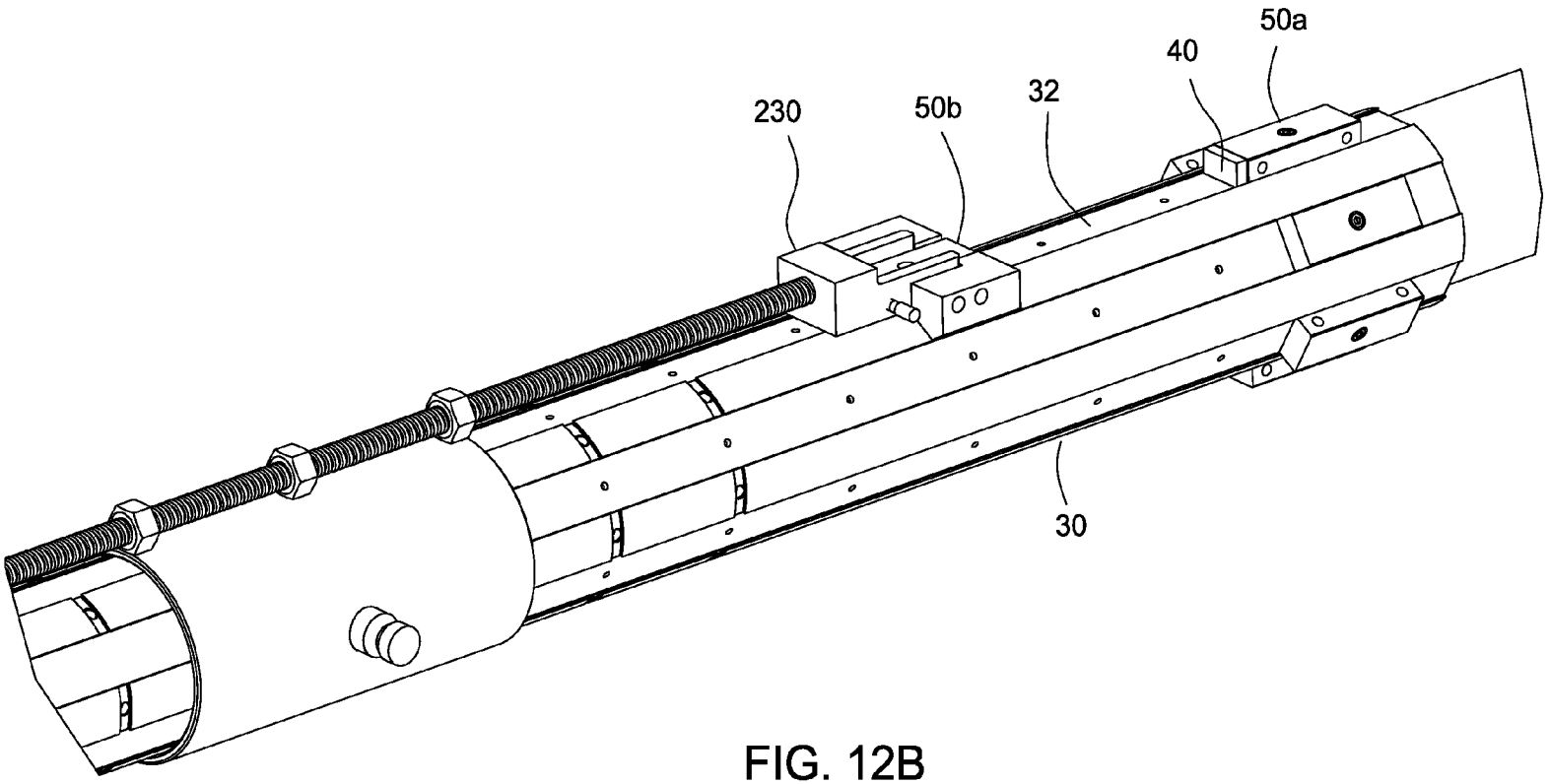
Figure 12C:
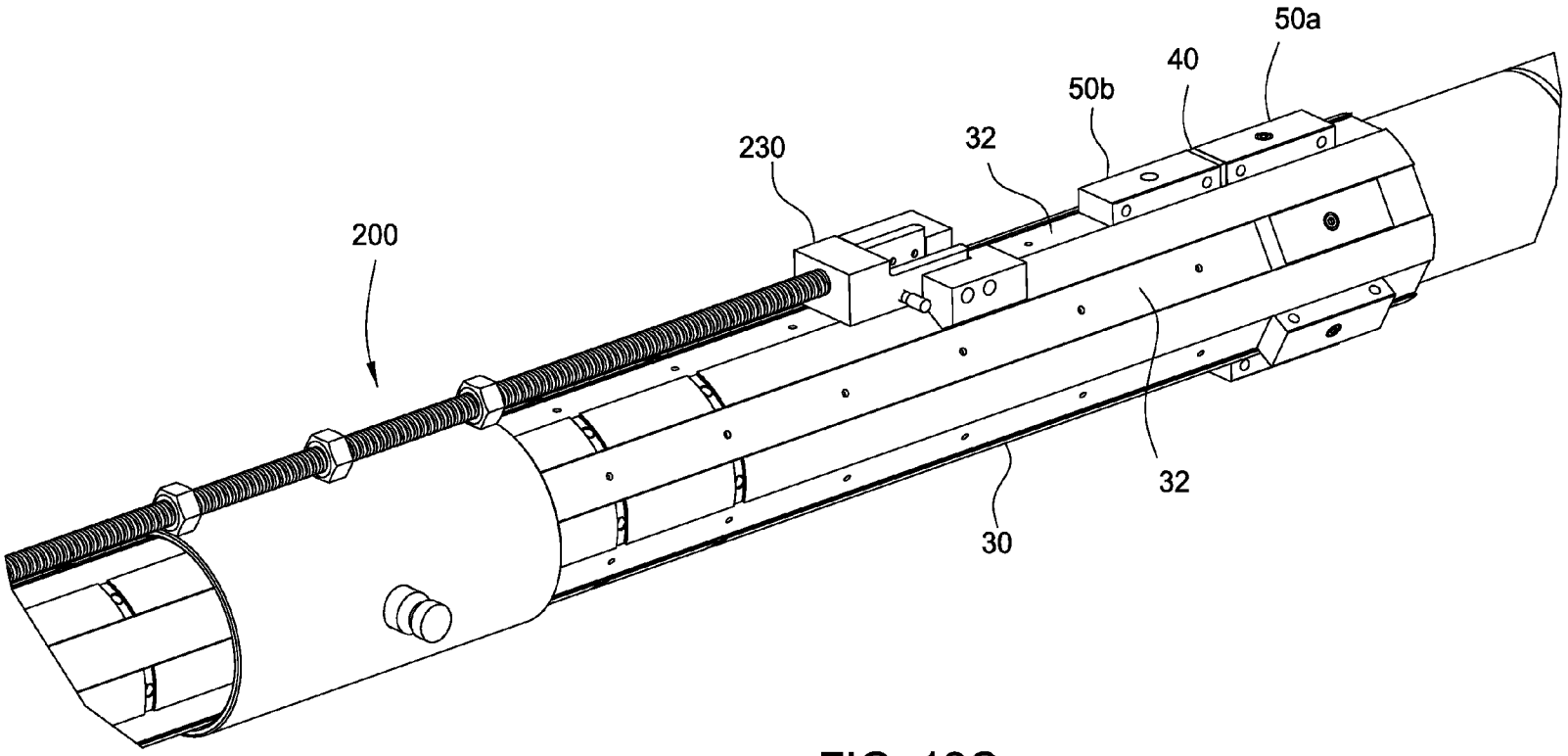
Figure 12D:
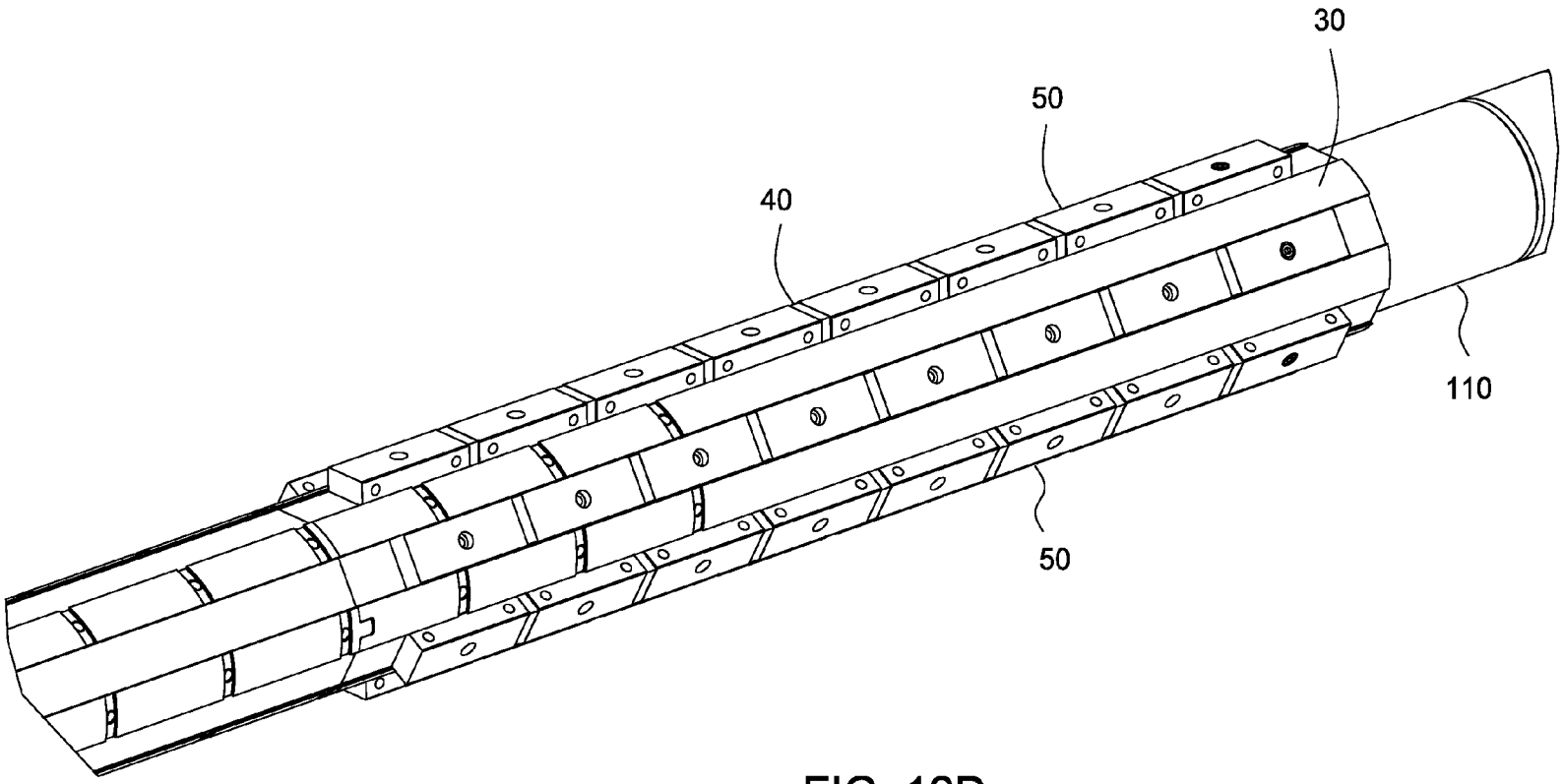

To install another magnet, the collar 211 is released from the inner sleeve 30 by unlocking the locking device 213. Then, the collar 211 is rotated until the holder 230 is aligned with the next intended channel 32, and the locking device 213 is allowed to engage with the inner sleeve 30, as shown in FIG. 12. In one embodiment, rotation of the collar 211 may be guided by the slot 134 in the inner sleeve 30. To reposition the collar 211 axially, the collar 211 is moved axially until the locking device 213 engages a slot 134 on the inner sleeve 30. Then, the collar 211 is rotated until locking device 213 engages the aperture 36 in the inner sleeve 30. FIG. 12A shows a row of magnets 50*a* assembled on the inner sleeve 30, and a magnet 50*b* is held by the holder 220. It must noted that the magnets 50*a* may be assembled in any suitable order, such as installing two magnets in each channel before repositioning the assembly tool 200 to install a magnet in another channel. In FIG. 12B, an optional spacer 40 is disposed between two magnets 50*a*, 50*b* in the same channel 32. FIG. 12C shows the magnets 50*a*, 50*b* in position and attached to the inner sleeve 30. The holder 230 is ready to be repositioned to install the next magnet in the second row of a different channel 32. This process may be repeated until all of magnets 50 are installed. FIG. 12D shows all of the magnets 50 assembled on channels 32 of the inner sleeve 30. A spacer 40 disposed between two adjacent magnets 50 in the same channel 32.

Figure 13A:
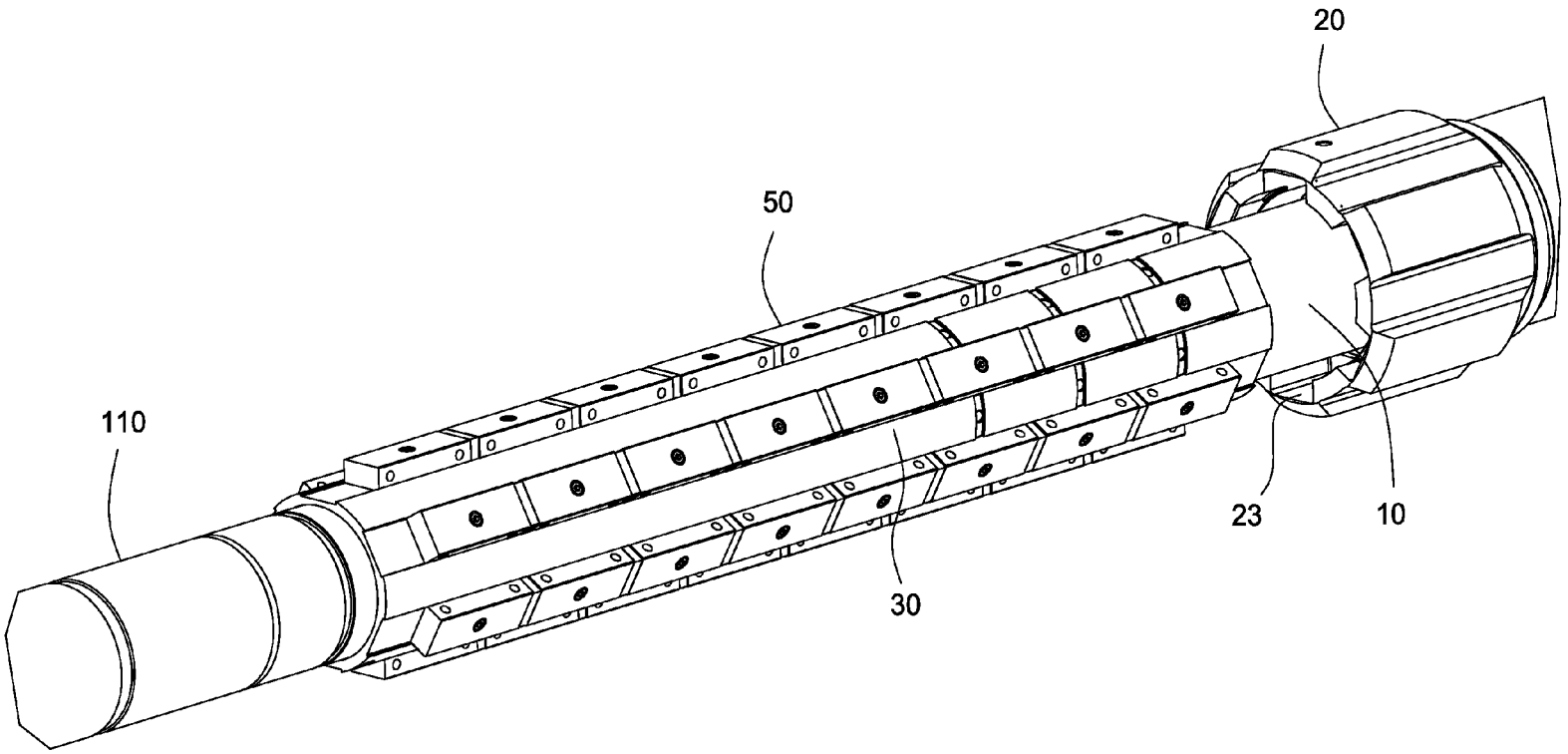
FIGS. 13A-13E show additional steps of assembling a retrieval tool, wherein the inner sleeve is attached to a stabilizer.
Figure 13B:
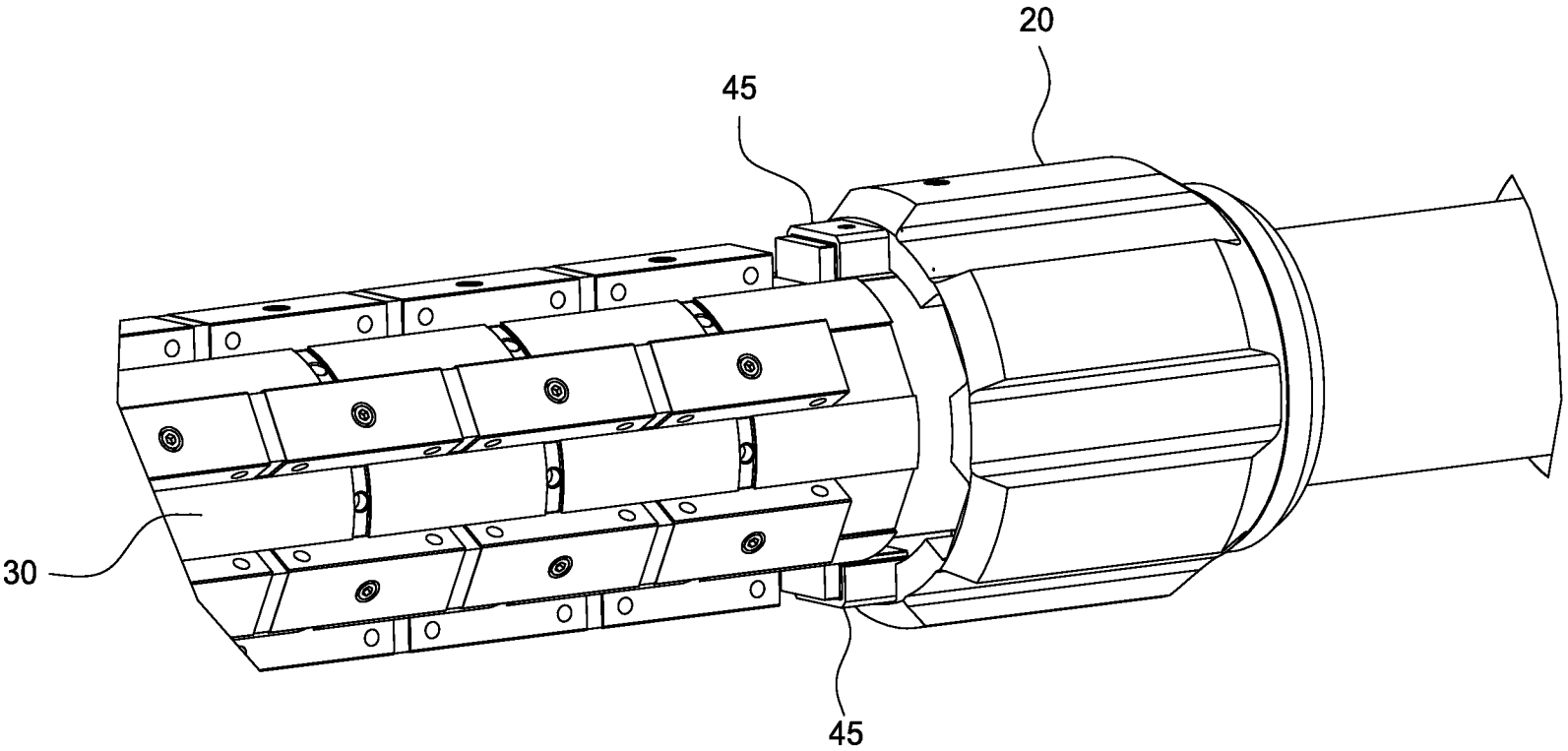
Figure 13C:
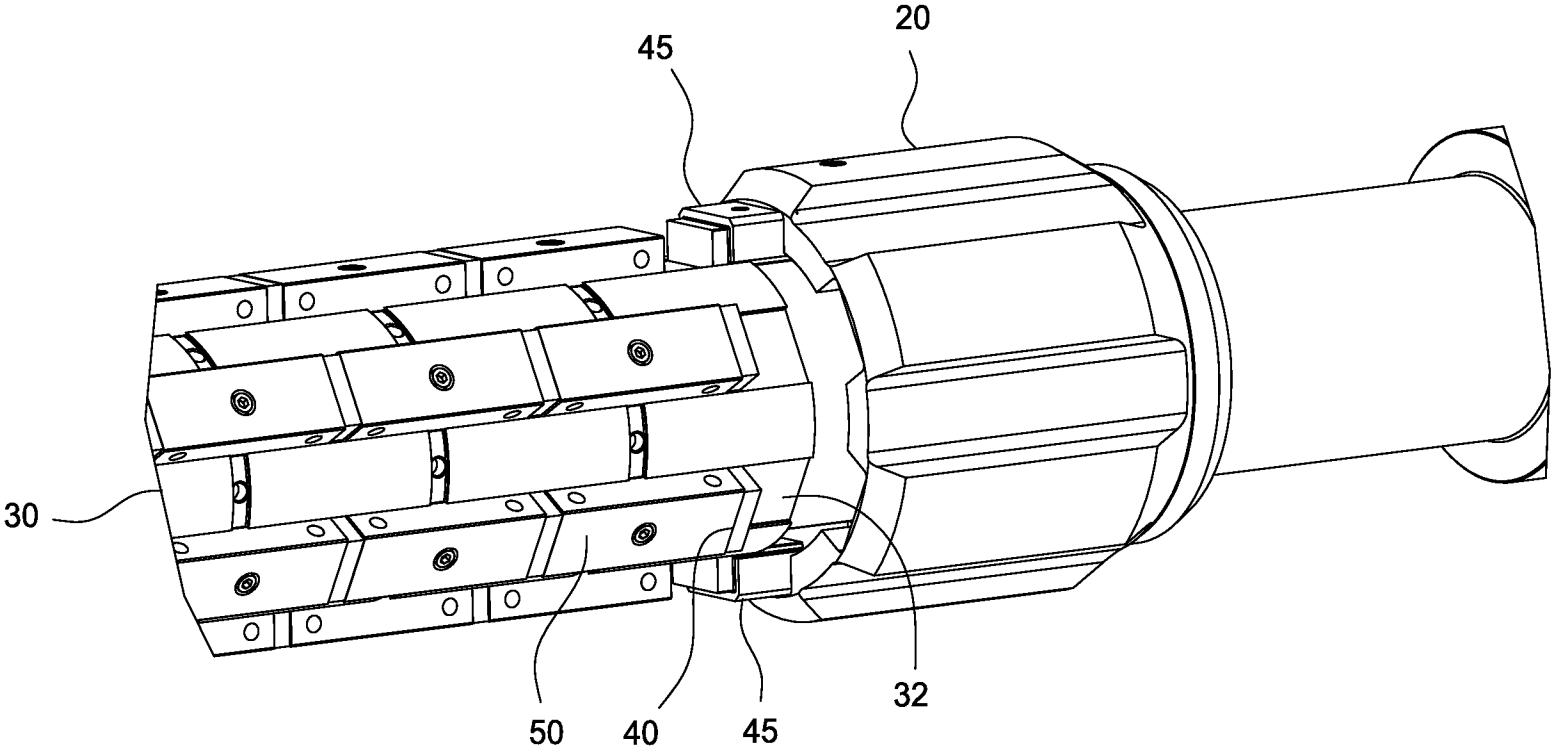
Figure 13D:
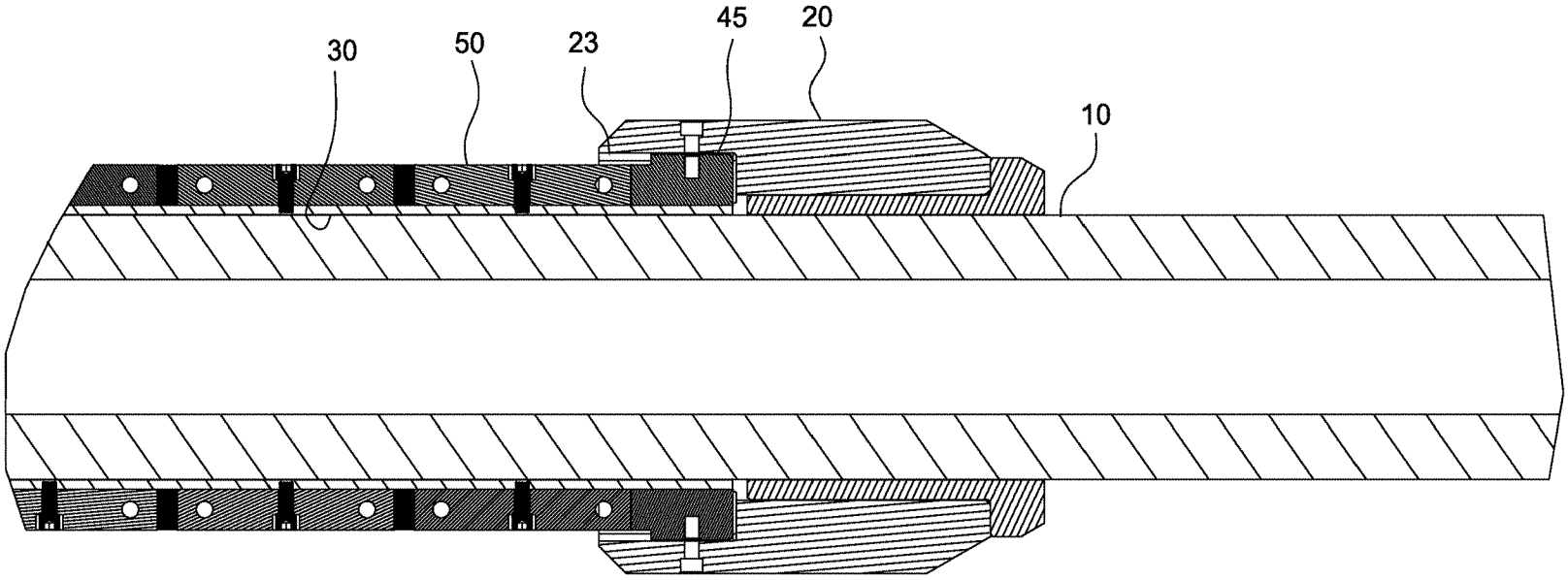
Figure 13E:
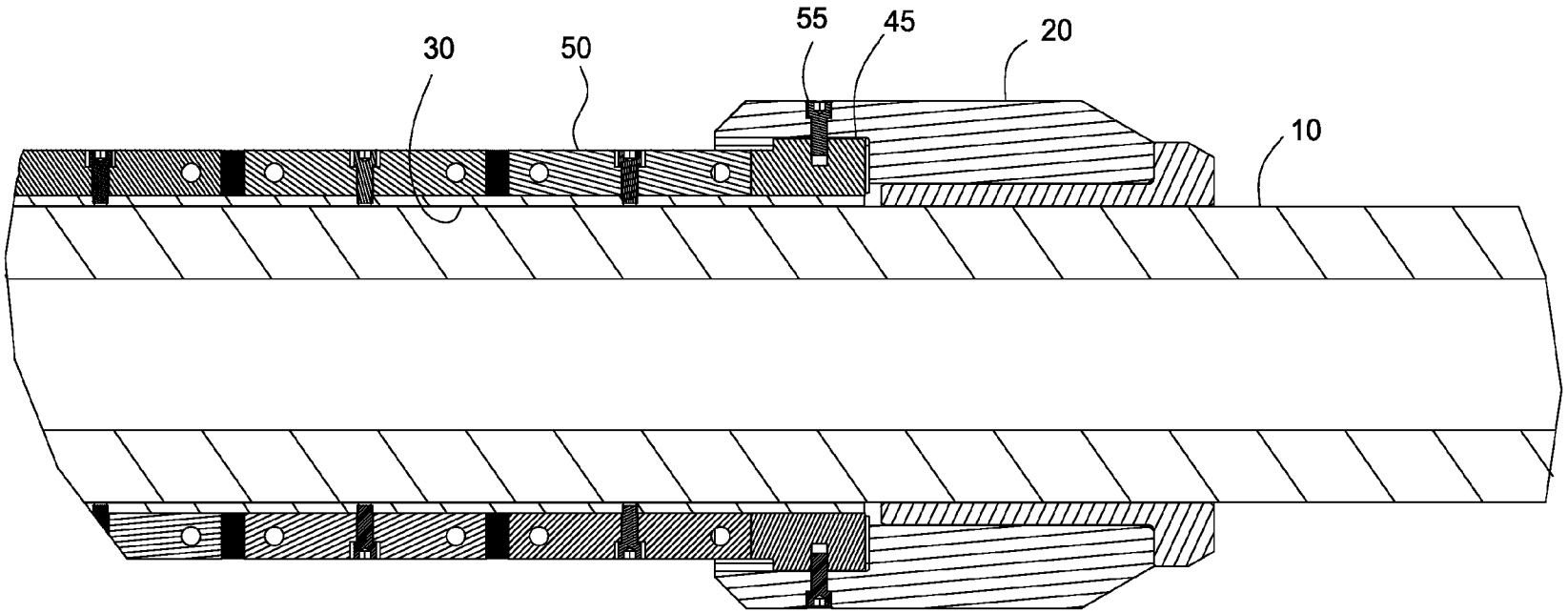

Thereafter, the inner sleeve 30 is released from the extension mandrel 110 by removing the fastener 112. The inner sleeve 30 is moved onto the mandrel 10 toward the stabilizer 20, as shown in FIG. 13A. In FIG. 13B, which is a partial view, two keys 45 are positioned at the end of the inner sleeve 30. As shown, the keys 45 are located in channels 32 on opposite sides of the inner sleeve 30. In FIG. 13C, spacers 40 are disposed in channels 32 and adjacent to the magnet 50 at the end. Spacers 40 may optionally be disposed between a magnet 50 and the key 45. In FIG. 13D, the inner sleeve 30 is inserted into the stabilizer 20 until the keys 45 are in the groove 23 of the stabilizer 20. In FIG. 13E, the keys 45 are attached to the stabilizer 20 using a bolt 55. In one embodiment, the bearing 15, stabilizer 20, and the magnets 50 are optionally moved to one end of the recess 17 in the mandrel 10 to continue the installation process.

Figure 14:
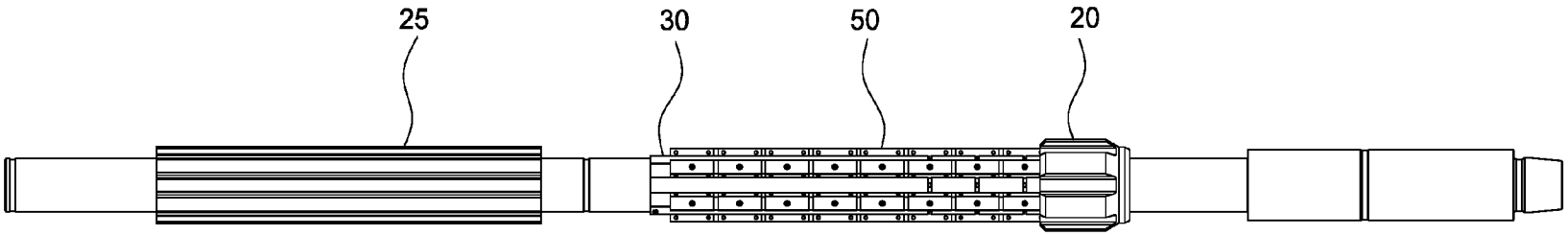
FIGS. 14 and 14A-14E show additional steps of assembling a retrieval tool, wherein the housing sleeve and the other stabilizer are installed.
Figure 14A:
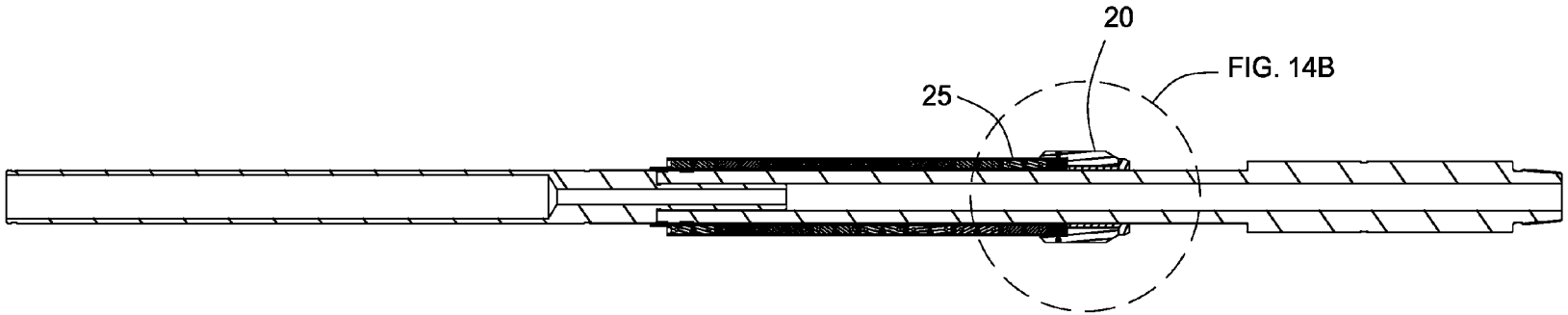
Figure 14B:
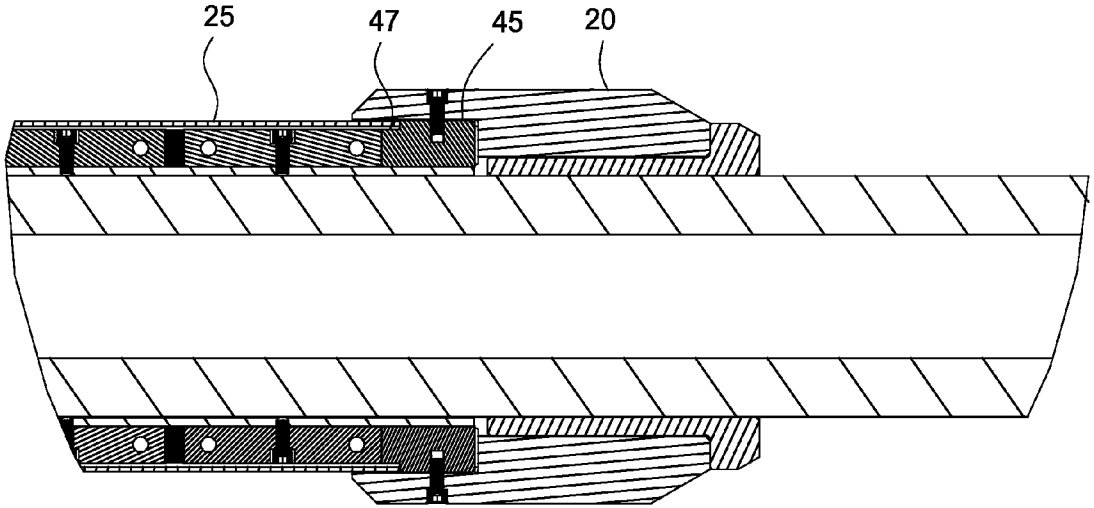
Figure 14C:
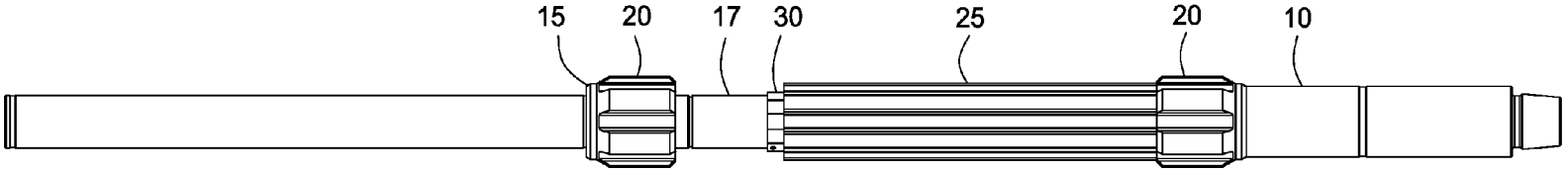
Figure 14D:
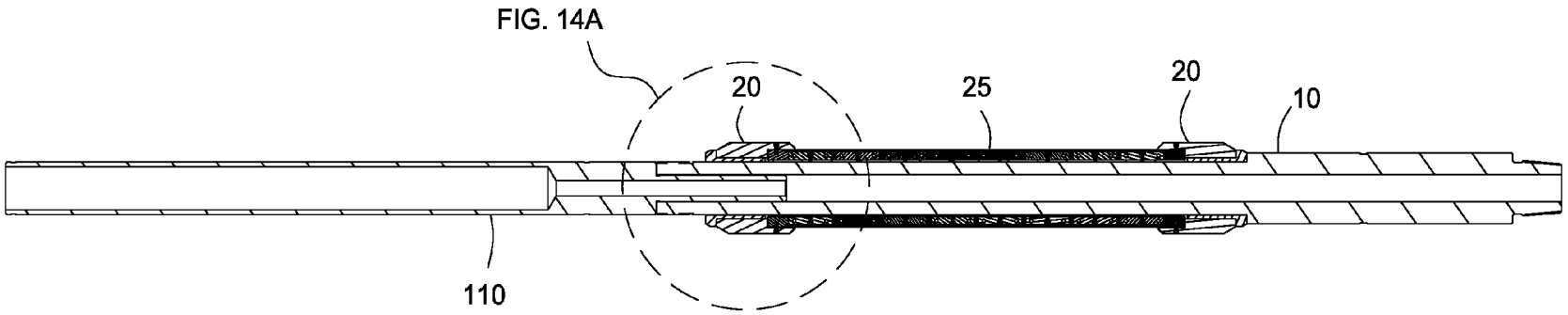
Figure 14E:
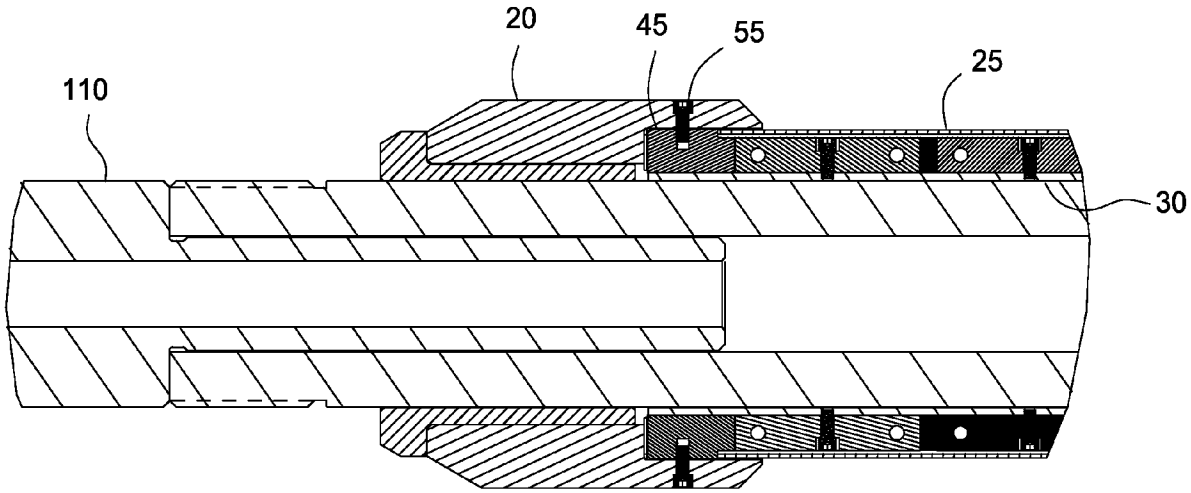

In FIG. 14, the housing sleeve 25 is ready to be positioned around the magnets 50. The housing sleeve 25 has a profile that complements the shape of the magnets 50 and the inner sleeve 30. As previously described, the housing 25 has valleys 29 that are aligned with the valleys 59 between the magnets 50. FIG. 14A is a cross-sectional view of the retrieval tool 100 after the housing sleeve 25 has been installed. FIG. 14B is an enlarged view showing the housing sleeve 25 disposed between the keys 45 and the stabilizer 20. In this embodiment, the housing sleeve 25 is received in the recess 47 of the keys 45. In FIG. 14C, the lower stabilizer 20 has been moved to the lower end of the recessed portion 17, and the other stabilizer 20 and bearing 15 are positioned on the upper end of the mandrel 10. FIG. 14D is a cross-sectional view of the retrieval tool 100 after the upper stabilizer 20 has been installed. FIG. 14E is an enlarged partial view showing the keys 45 disposed on the inner sleeve 30, and the stabilizer 20 is attached to the keys 45 using bolts 55. Thereafter, the extension mandrel 110 is released from the mandrel 10. Then, the upper end 13 is attached to the mandrel 10 to complete the assembly, as shown in FIGS. 1 and 1A.

In one embodiment, a downhole retrieval tool includes a mandrel; an inner sleeve disposed around the mandrel; a plurality of magnets coupled to the inner sleeve; and an outer sleeve disposed around the plurality of magnets, wherein the inner sleeve and the plurality of magnets are rotatable relative to the mandrel.

In one or more of the embodiments described herein, the inner sleeve includes one or more channels for receiving the plurality of magnets.

In one or more of the embodiments described herein, each magnet includes a "north" pole and a "south" pole," wherein the north pole is disposed on the left side or the right side of the magnet and the south pole is disposed on the other side of the magnet.

In one or more of the embodiments described herein, the tool includes a stabilizer coupled to each end of the inner sleeve.

In one or more of the embodiments described herein, the tool includes a bearing disposed between the stabilizer and the mandrel.

In one or more of the embodiments described herein, the tool includes a key and groove connection for coupling the inner sleeve to the stabilizer.

In one or more of the embodiments described herein, the stabilizer includes a valley aligned with a valley of the inner sleeve.

In one or more of the embodiments described herein, the tool includes a spacer disposed between two adjacent magnets.

In one or more of the embodiments described herein, at least one magnet includes a retainer bore to facilitate handling of the at least one magnet.

In another embodiment, a method of assembling a downhole retrieval tool includes providing an assembly tool having an anchor, a conveyance, and a holder; disposing an inner sleeve around a mandrel; coupling the anchor to the inner sleeve; using the holder to retain a magnet; operating the conveyance to move the magnet to a desired location on the inner sleeve; attaching the magnet to the inner sleeve; and moving the holder away from the magnet.

In one or more of the embodiments described herein, the method includes decoupling the anchor from the inner sleeve; repositioning the anchor; retaining a second magnet; and operating the conveyance to move the second magnet to another location on the inner sleeve.

In one or more of the embodiments described herein, the method includes repositioning the anchor by at least one of rotating the anchor relative to the inner sleeve and axially moving the anchor relative to the inner sleeve.

In one or more of the embodiments described herein, coupling the anchor to the inner sleeve comprises inserting a locking device into an aperture of the inner sleeve.

In one or more of the embodiments described herein, the inner sleeve includes a slot for receiving the locking device.

In one or more of the embodiments described herein, the conveyance is coupled to the anchor using threads, and operating the conveyance comprises rotating the conveyance relative to the anchor.

In one or more of the embodiments described herein, retaining the magnet comprises inserting a retainer into a retainer bore in the magnet.

In one or more of the embodiments described herein, the method includes providing the assembly tool with a guide member.

In another embodiment, an assembly tool for handling a magnet includes an anchor; a conveyance movable relative to the anchor; and a magnet holder coupled to and movable with the conveyance, wherein the magnet holder includes an arm for retaining the magnet.

In one or more of the embodiments described herein, the tool includes a retainer for coupling with a retainer bore in the magnet.

In one or more of the embodiments described herein, the retainer is inserted through the arm of the magnet holder.

In one or more of the embodiments described herein, the anchor is tubular shaped and includes a retracting locking device for anchoring the assembly tool.

In one or more of the embodiments described herein, the conveyance is threadedly coupled to the anchor.

In one or more of the embodiments described herein, the tool includes a guide member attached to the arm.

In another embodiment, a method of assembling a downhole retrieval tool includes providing an assembly tool having an anchor, a conveyance, and a holder; disposing an inner sleeve around a mandrel; coupling anchor to the inner sleeve; using the holder to retain a magnet; operating the conveyance to move the magnet to a desired location on the inner sleeve; attaching the magnet to the inner sleeve; and moving the holder away from the magnet.

In another embodiment, an assembly tool for handling a magnet includes an anchor; a conveyance movable relative to the anchor; and a magnet holder coupled to the conveyance, wherein the magnet holder includes an arm for retaining the magnet.

The features and mechanisms of each embodiment may be interchangeable with the other embodiments described herein. Additionally, while the foregoing is directed to embodiments of the present invention, other and further embodiments of the invention may be devised without departing from the basic scope thereof, and the scope thereof is determined by the claims that follow.

The invention claimed is:

1. A downhole retrieval tool, comprising:

a mandrel having a longitudinal axis extending from a first end of the mandrel to a second end of the mandrel;

an inner sleeve disposed around the mandrel;

a plurality of magnets coupled to the inner sleeve; and an outer sleeve disposed around the plurality of magnets, wherein the inner sleeve and the plurality of magnets are rotatable relative to the mandrel, and wherein the outer sleeve includes a plurality of outer sleeve valleys that extend into a corresponding plurality of valleys between two adjacent magnets, wherein two adjacent outer sleeve valleys are circumferentially spaced relative to one another about the outer sleeve, the plurality of outer sleeve valleys extending along the longitudinal axis from the first end of the mandrel to the second end of the mandrel.

2. The tool of claim 1, wherein the inner sleeve includes one or more channels for receiving the plurality of magnets.

3. The tool of claim 2, wherein each magnet is attached to the inner sleeve by a fastener extending through the magnet and a fastener aperture in the corresponding channel.

4. The tool of claim 3, further comprising a plurality of apertures extending between two adjacent channels.

5. The tool of claim 1, wherein each magnet includes a "north" pole and a "south" pole," wherein the north pole is disposed on a left side or a right side of the magnet and the south pole is disposed on the other side of the magnet.

6. The tool of claim 1, further comprising two stabilizers, wherein one stabilizer is coupled to each end of the inner sleeve.

7. The tool of claim 6, further comprising a bearing disposed between each stabilizer and the mandrel.

8. The tool of claim 6, further comprising a key and groove connection for coupling the inner sleeve to the stabilizers.

9. The tool of claim 8, wherein the key has a groove configured to receive the outer sleeve.

10. The tool of claim 1, wherein each stabilizer includes a plurality of stabilizer valleys, wherein each stabilizer valley is aligned with a corresponding outer sleeve valley.

11. The tool of claim 1, further comprising a spacer disposed between two adjacent magnets, wherein the spacer contacts both adjacent magnets.

12. The tool of claim 1, wherein at least one magnet includes at least two retainer bores to facilitate handling of the at least one magnet.

13. A downhole retrieval tool, comprising:

a mandrel having a longitudinal axis extending from a first end of the mandrel to a second end of the mandrel;

an inner sleeve disposed around the mandrel;

a plurality of magnetic columns coupled to the inner sleeve; the plurality of magnetic columns having a plurality of magnets, wherein the plurality of magnetic columns are circumferentially spaced around the inner sleeve; and an outer sleeve disposed around the plurality of magnetic columns, wherein the inner sleeve and the plurality of magnetic columns are rotatable relative to the mandrel, and wherein the outer sleeve includes a plurality of outer sleeve valleys that extend into and aligned with a corresponding plurality of valleys between two adjacent magnetic columns, the plurality of outer sleeve valleys extending along the longitudinal axis from the first end of the mandrel to the second end of the mandrel.

14. The tool of claim 13, wherein the inner sleeve includes a plurality of channels for receiving the plurality of magnetic columns, wherein each magnetic column is partially disposed in a corresponding channel.

15. The tool of claim 14, wherein each magnet in each magnetic column is attached to the inner sleeve by a fastener extending through the magnet and a fastener aperture in each channel.

16. The tool of claim 15, wherein each magnet in each magnetic column includes at least one retainer bore to facilitate handling of each magnet.

17. The tool of claim 15, further comprising a column of apertures between two adjacent channels.

18. The tool of claim 13, further comprising a spacer disposed between two adjacent magnets in each magnetic column, wherein each spacer contacts both adjacent magnets.

19. A downhole retrieval tool, comprising:

a mandrel having a longitudinal axis extending from a first end of the mandrel to a second end of the mandrel;

an inner sleeve disposed around the mandrel;

a plurality of magnetic columns having a first end and a second end coupled to the inner sleeve, each magnetic column extending in a direction of the longitudinal axis from the first end to the second end, each of the plurality of magnetic columns having a plurality of magnets; and an outer sleeve disposed around the plurality of magnetic columns, wherein the inner sleeve and the plurality of magnetic columns are rotatable relative to the mandrel, and wherein the outer sleeve includes a plurality of outer sleeve valleys that extend into a corresponding plurality of valleys between two adjacent magnetic columns, wherein the plurality of outer sleeve valleys and the corresponding plurality of valleys between two adjacent magnetic columns both extend in the direction of the longitudinal axis.

20. The tool of claim 19, wherein the inner sleeve includes a plurality of channels for receiving the plurality of magnetic columns, wherein each magnetic column is partially disposed in a corresponding individual channel of the plurality of channels.

21. The tool of claim 20, wherein each magnet is attached to the inner sleeve by a fastener extending through the magnet and a fastener aperture in the corresponding individual channel of the plurality of channels.

22. The tool of claim 21, further comprising a column of apertures extending in the direction of the longitudinal axis between two adjacent channels of the plurality of channels.

23. The tool of claim 21, wherein each magnet includes at least one retainer bore to facilitate handling of each magnet.

* * * * *